US012364916B2

(12) United States Patent
Taylor et al.

(10) Patent No.: US 12,364,916 B2
(45) Date of Patent: Jul. 22, 2025

(54) MOVABLE CONSOLE

(71) Applicant: iFIT Inc., Logan, UT (US)

(72) Inventors: Keith A. Taylor, Plain City, UT (US); Trenton Von Larsen, Hyrum, UT (US); Grant Clove, Logan, UT (US); Tyler Fallentine, Providence, UT (US); Luke Downs, Smithfield, UT (US)

(73) Assignee: iFIT Inc., Logan, UT (US)

( * ) Notice: Subject to any disclaimer, the term of this patent is extended or adjusted under 35 U.S.C. 154(b) by 208 days.

(21) Appl. No.: 18/082,150

(22) Filed: Dec. 15, 2022

(65) Prior Publication Data

US 2023/0181993 A1 Jun. 15, 2023

Related U.S. Application Data

(60) Provisional application No. 63/289,997, filed on Dec. 15, 2021.

(51) Int. Cl.
*A63B 71/06* (2006.01)
*A63B 22/02* (2006.01)

(52) U.S. Cl.
CPC ..... *A63B 71/0619* (2013.01); *A63B 22/02* (2013.01); *A63B 2071/0658* (2013.01)

(58) Field of Classification Search
CPC ..... A63B 71/0619; A63B 22/02; A63B 2071/0658; A63B 21/072; A63B 21/4043; A63B 22/0076; A63B 22/0605; A63B 22/0664; A63B 23/00
See application file for complete search history.

(56) References Cited

U.S. PATENT DOCUMENTS 4,976,424 A * 12/1990 Sargeant ..... A63B 21/0053 482/3
8,764,609 B1 * 7/2014 Elahmadie ..... A63B 23/0211 482/57
10,500,473 B2 * 12/2019 Watterson ..... A63B 22/0023
2006/0058163 A1 * 3/2006 Matsumoto ..... A63B 22/0605 482/57
2008/0093517 A1 * 4/2008 Chen ..... A63B 22/0605 482/57
2010/0077564 A1 * 4/2010 Saier ..... A63B 22/0605 16/242
2012/0046144 A1 * 2/2012 Lin ..... G06F 3/011 482/8
2013/0102440 A1 * 4/2013 Hutchins ..... A63B 71/0619 482/8
2018/0117419 A1 * 5/2018 Jackson ..... A63B 71/0622
2021/0275866 A1 * 9/2021 Rogus ..... A63B 22/001
2022/0016511 A1 * 1/2022 Rozo ..... A63B 71/0619
2022/0062736 A1 * 3/2022 Farrell ..... A63B 71/0619
2022/0134179 A1 * 5/2022 Taylor ..... A63B 22/0605 482/4

(Continued)

*Primary Examiner* — Andrew S Lo
(74) *Attorney, Agent, or Firm* — Holland & Hart LLP

(57) ABSTRACT

A console for an exercise device includes a translational mechanism and a rotational mechanism. During operation, a component of the exercise device may prevent rotation or at least partially obscure the user's view of the display. The translational mechanism may move the console out of the way of the component so that the console may be moved and the display visible to the user when performing an exercise activity while dismounted from the exercise device.

20 Claims, 16 Drawing Sheets

(56) References Cited

U.S. PATENT DOCUMENTS

| | | | | |
|---|---|---|---|---|
| 2022/0280856 | A1* | 9/2022 | Baker | F16M 11/2078 |
| 2023/0026251 | A1* | 1/2023 | Tracy | F16M 11/043 |
| 2023/0181993 | A1* | 6/2023 | Taylor | A63B 22/02 482/1 |

* cited by examiner

MOVABLE CONSOLE

CROSS-REFERENCE TO RELATED APPLICATIONS

This application claims priority to and the benefit of U.S. Provisional Patent Application No. 63/289,997, filed Dec. 15, 2021, which is incorporated by reference in its entirety.

BACKGROUND

Exercise is popular activity that many people perform to improve their physical and/or mental health. Exercise devices are often utilized to allow a person to exercise a variety of muscles in a variety of activities.

BRIEF SUMMARY

In some embodiments, an exercise device includes a frame and a display movably connected to the frame. The display is movable between a first rotational position, a second rotational position, a first translational position, and a second translational position. A translation mechanism facilitates movement of the display between the first translational position and the second translational position. A rotation mechanism facilitates movement of the display between the first rotational position and the second rotational position. A component is connected to the frame. The component physically prevents rotation of the display to the second rotational position when the display is in the first rotational position and the first translational position. When the display moves to the second translational position, the component does not block rotation of the display nor obscure the portion of the display.

In some embodiments, a method for operating an exercise device includes operating the exercise device with a display in a first rotational position and a first translational position. The display is rotated around a vertical axis to a second rotational position. A component of the exercise device prevents viewing of the display in the second rotational position and the first translational position. The display is translated laterally from the first translational position to a second translational position. The exercise device is operated with the display in the second rotational position and the second translational position, and the component does not prevent viewing the display in the second rotational position and the second translational position.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 1-2 is a front view of the exercise device of FIG. 1-1 with the console in a translated position;

FIG. 1-3 is a front view of the exercise device of FIG. 1-1 with the console in a rotated position;

FIG. 2-1 is a representation of a front view of an exercise device with the console in a central position, according to at least one embodiment of the present disclosure;

FIG. 2-2 is a side view of the exercise device of FIG. 2-1 in a rotated position;

FIG. 2-3 is a side view of the exercise device in FIG. 2-1 in a rotated and translated position;

FIG. 3-1 is a representation of a rear view of a console in a central position, according to at least one embodiment of the present disclosure;

FIG. 3-2 is a rear view of the console of FIG. 3-1 in a translated position;

FIG. 4-1 is a representation of a side view of a console in an unrotated position, according to at least one embodiment of the present disclosure;

FIG. 4-2 is a cross-sectional front view of the console of FIG. 4-1 in a central position;

FIG. 4-3 is a cross-sectional front view of the console of FIG. 4-1 in a translated position;

FIG. 5-1 is a representation of a rear view of an exercise device with a console in a central position, according to at least one embodiment of the present disclosure;

FIG. 5-2 is a rear view of the exercise device of FIG. 5-1 with the console in a translated position;

DETAILED DESCRIPTION

This disclosure generally relates to an exercise device having a movable display. An exercise device can simulate a personal trainer giving instructions to a user. These instructions can be provided to the user via a display. The instructions may include one or more activities that are not performed using the exercise device, or which may involve the user dismounting the exercise device and performing the activity in a space around the exercise device. For example, the user might be positioned on the side of the exercise device while doing exercises instructed by the exercise device display, such as stretching, strength training, weight-lifting, and so forth. When the user dismounts the exercise device, he or she may not be able to see the display of the exercise device while standing away from of the exercise device. In accordance with embodiments of the present disclosure, the display may be rotated from facing the exercise device to facing the space where the user is performing the exercise activity. This may allow the user to view the display and utilize the exercise information presented thereon more easily.

Figure 1:
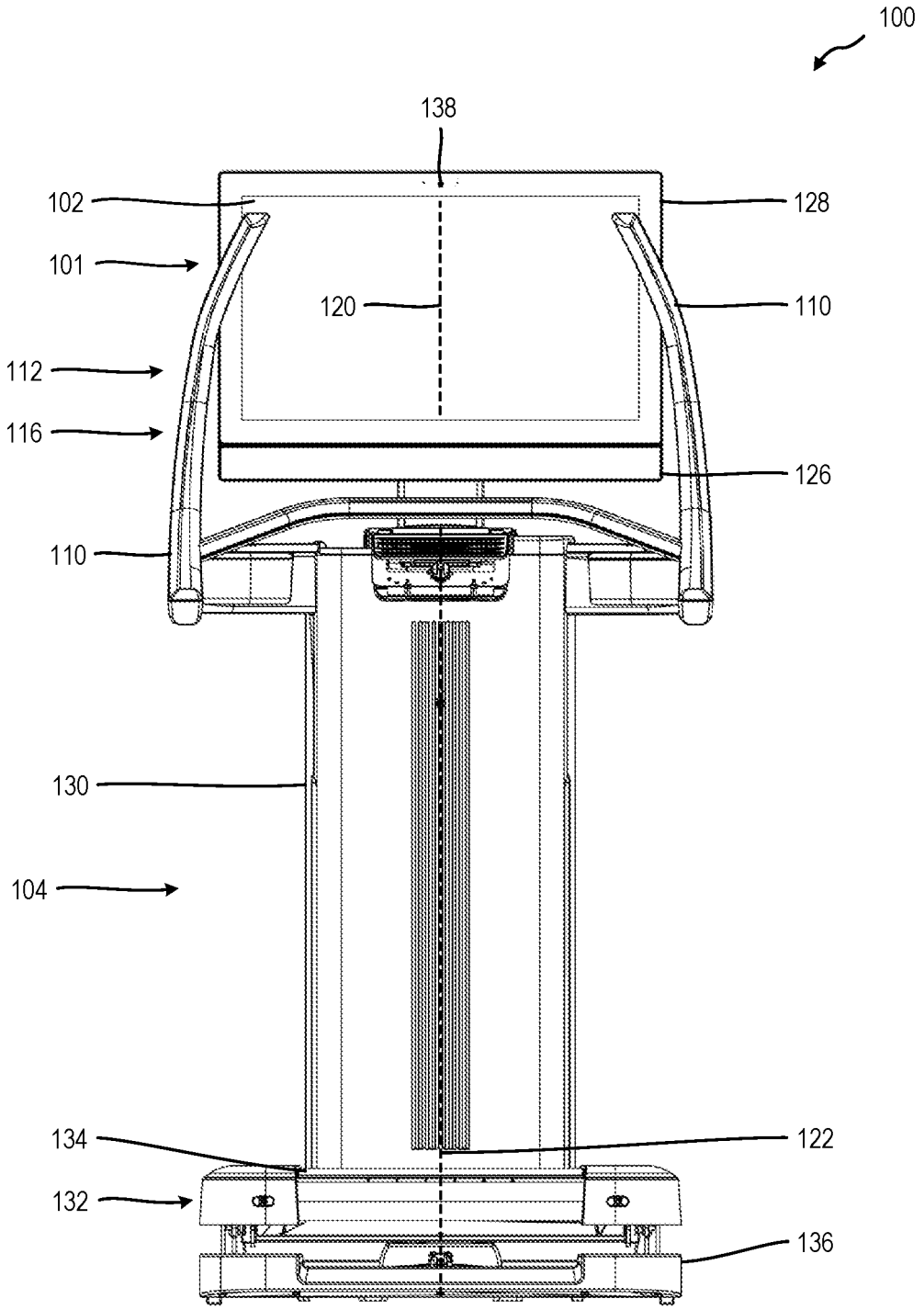
FIG. 1-1 is a representation of a front view of an exercise device with the console in a central position, according to at least one embodiment of the present disclosure.
Figures 1, 2:
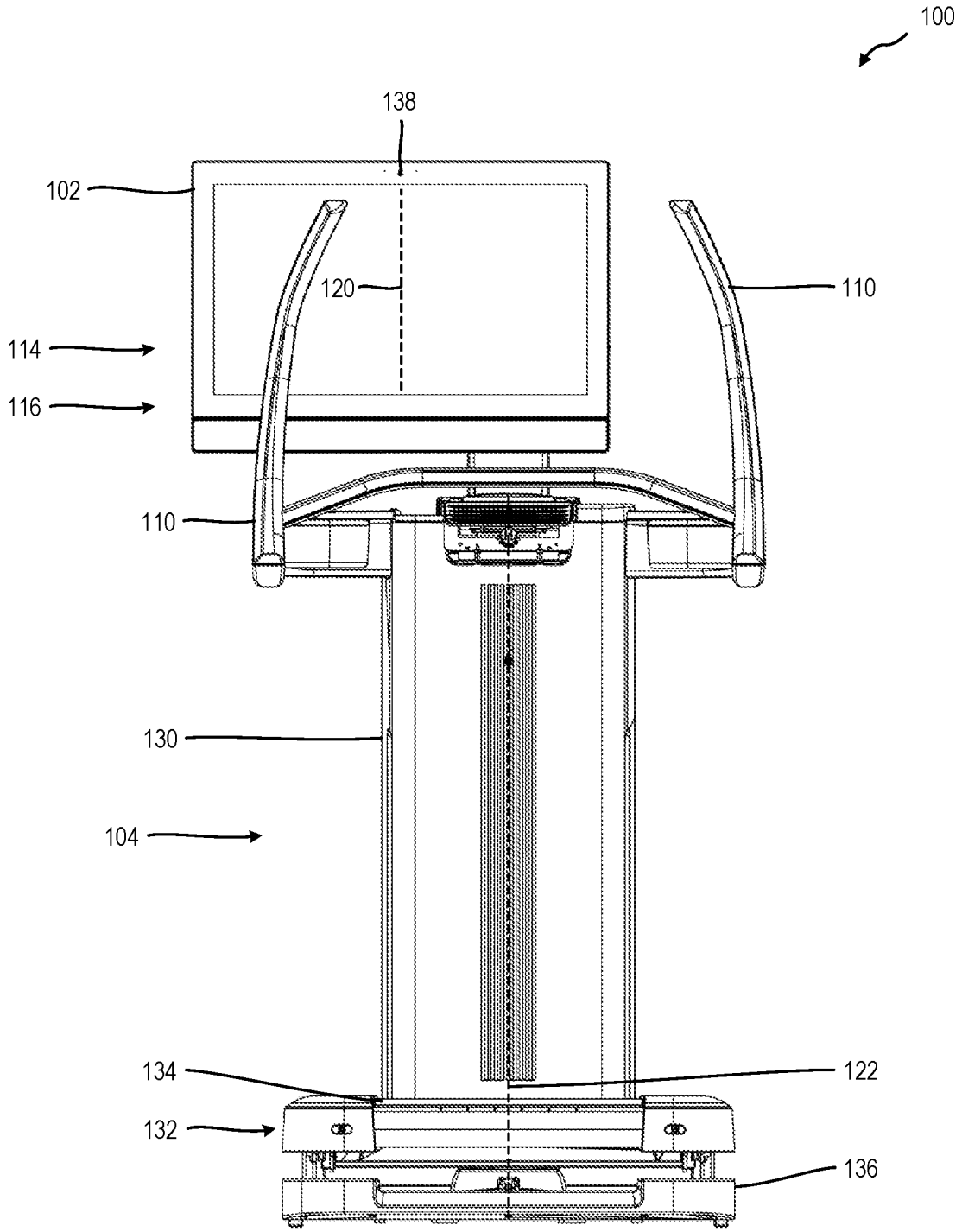
Figures 1, 2, 3:
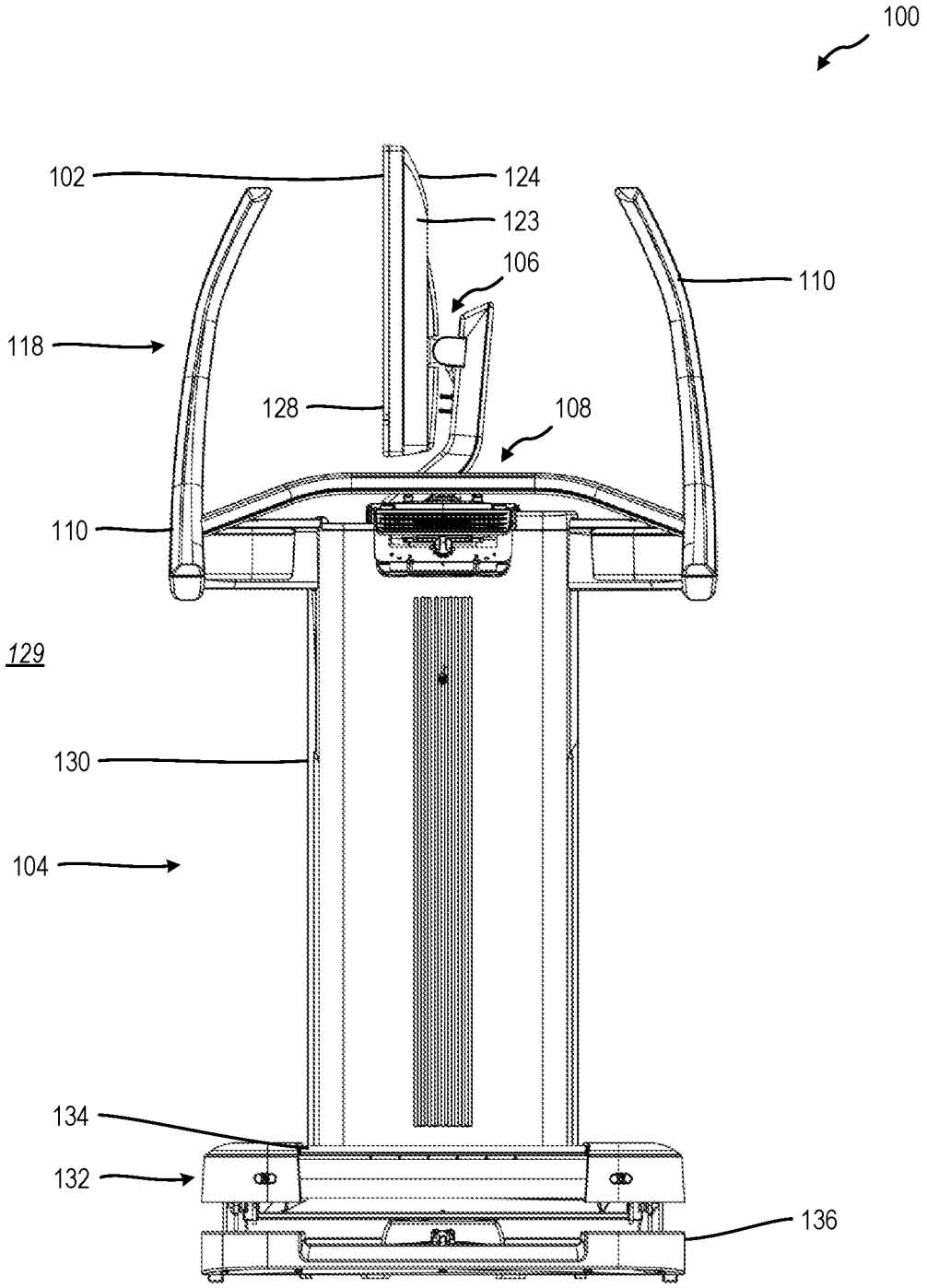
Figures 1, 2:
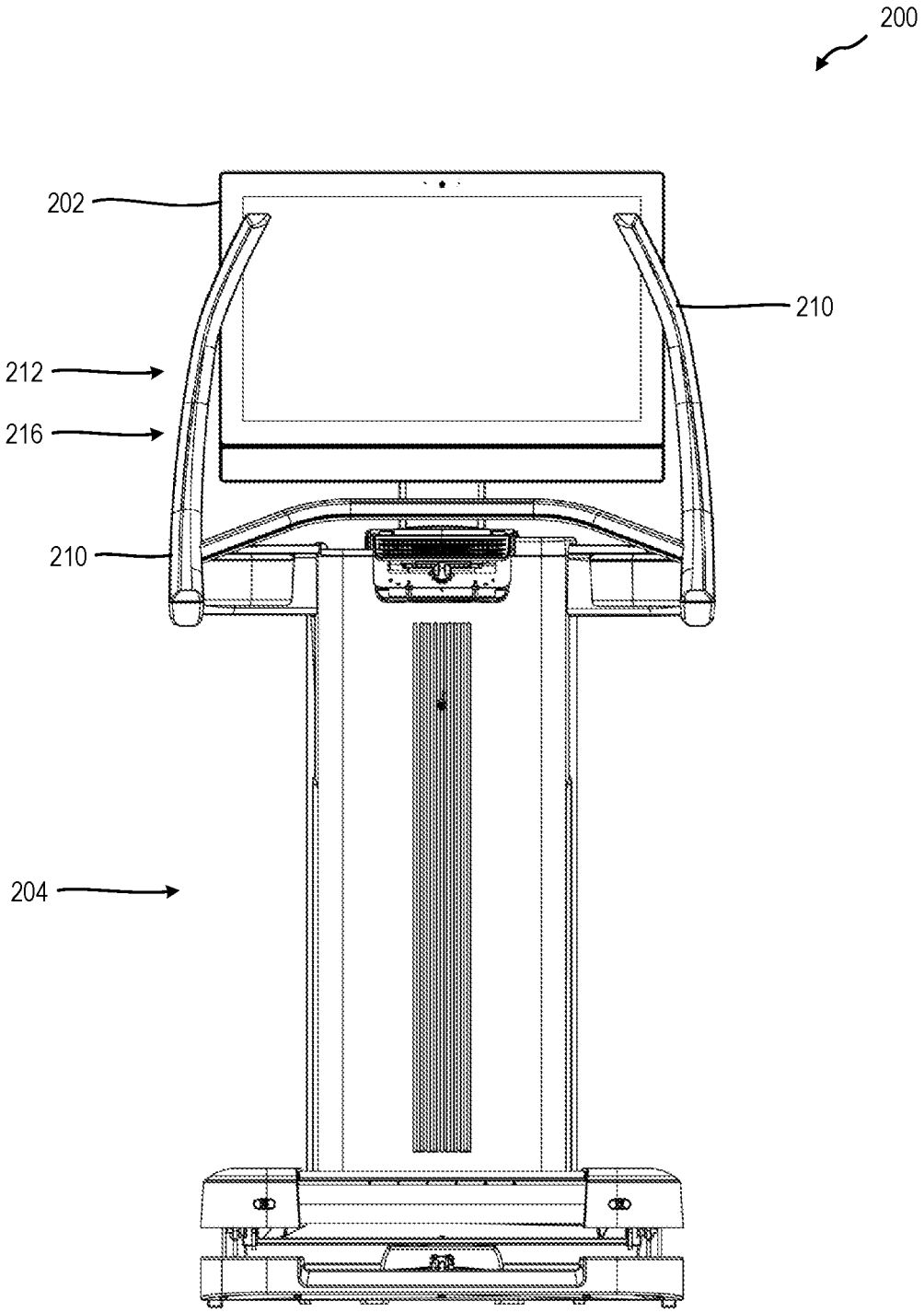
Figure 2:
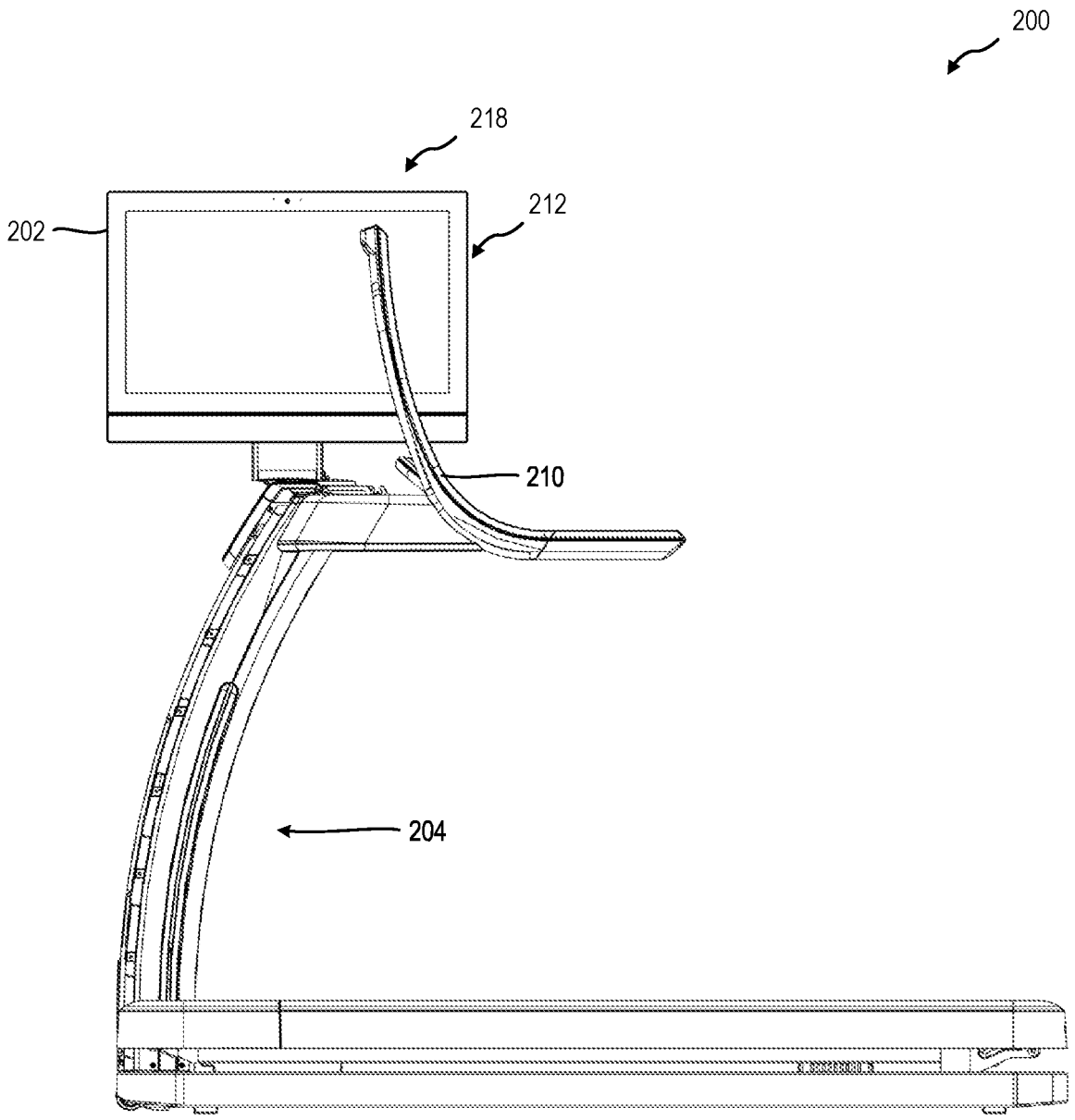
Figures 2, 3:
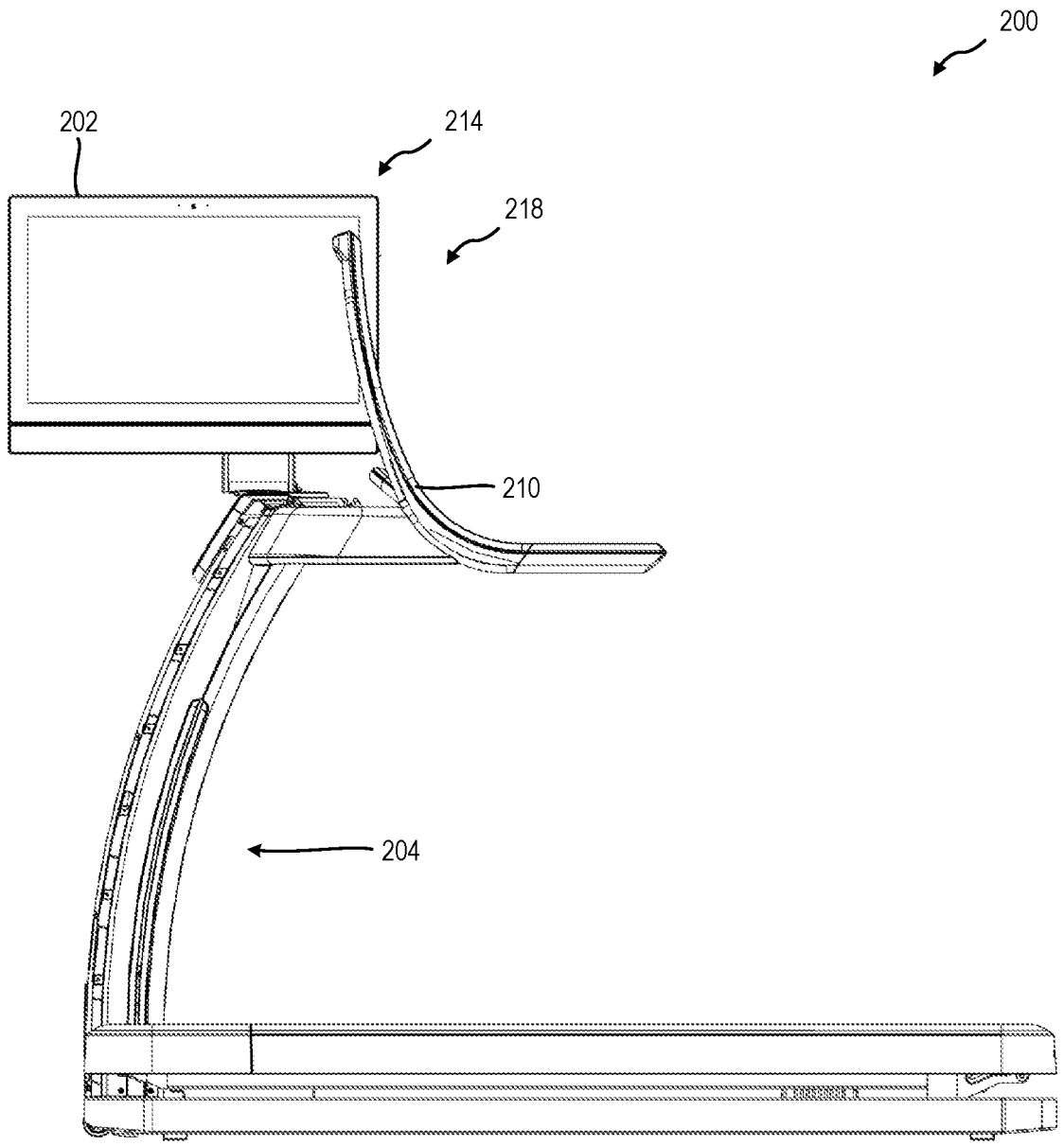
Figures 1, 3:
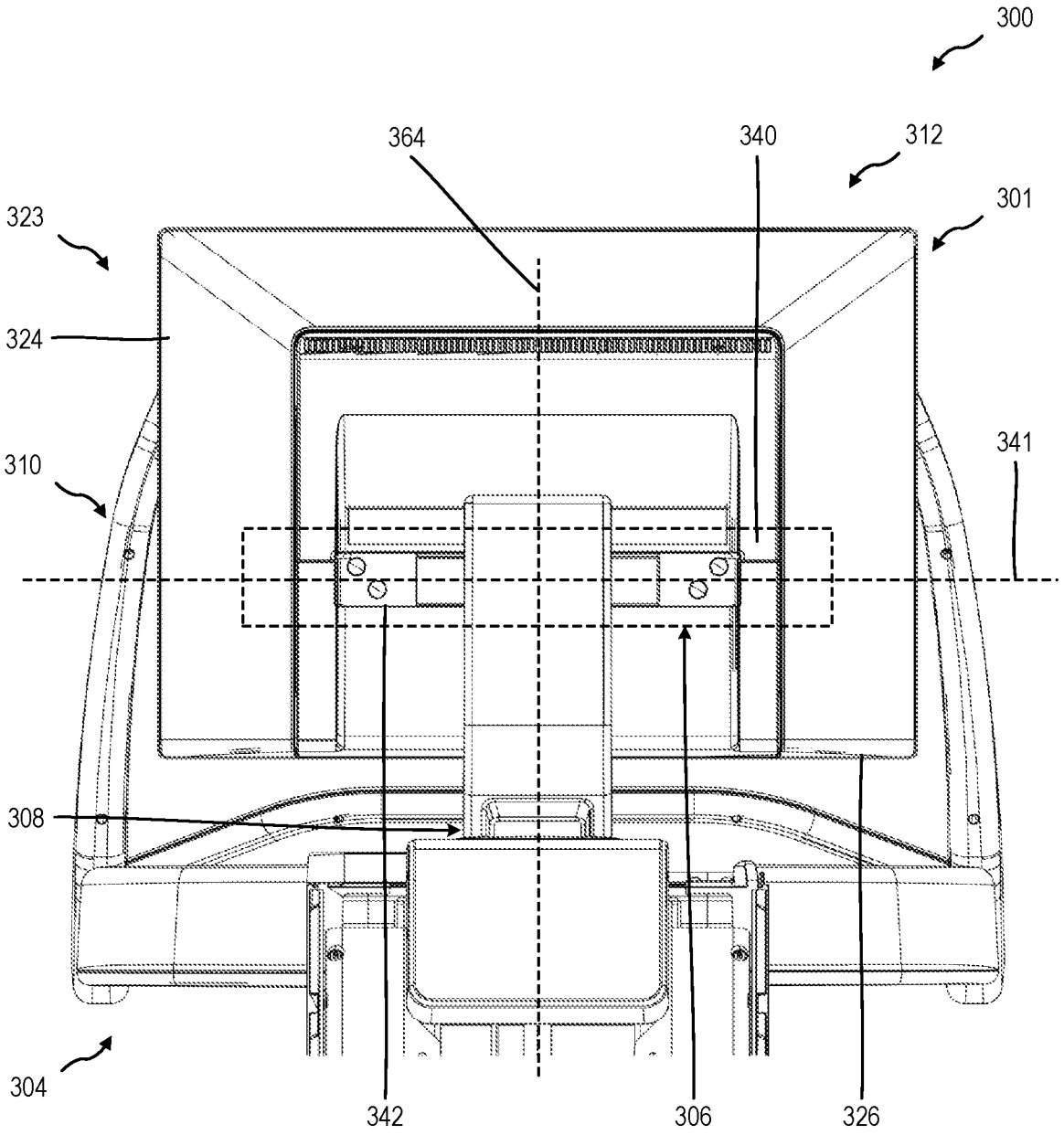
Figures 2, 3:
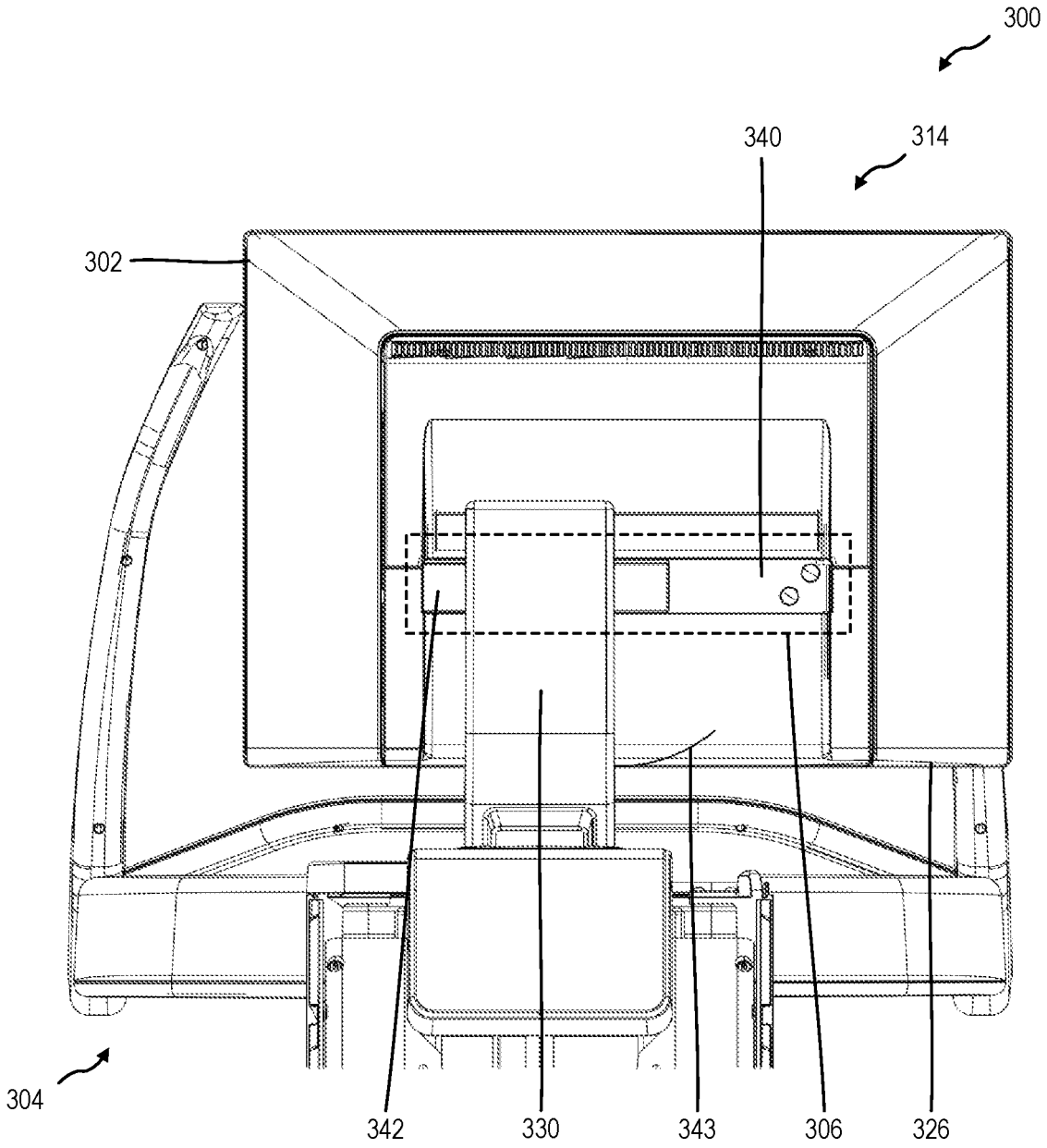

FIG. 1-1, FIG. 1-2, and FIG. 1-3 are showing a perspective front view of an exercise device 100, according to at least one embodiment of the present disclosure. The exercise device 100 includes a console 101 having a display 102, a frame 104, a translation mechanism 106, a rotation mechanism 108 and a component 110. In accordance with embodiments of the present disclosure, the console 101 may be a movable console. Put another way, the movable console 101 may change translational position, rotational position, and/or tilt position to face the user, thereby allowing the user to view exercise information on the display while performing exercise activities while dismounted from the exercise device 100. In the embodiment shown in FIG. 1-1, FIG. 1-2, and FIG. 1-3, the exercise device 100 is a treadmill. However, it should be understood that the exercise device 100 may be any type of exercise device, such as an elliptical device, an exercise bike, a rower, a cable resistance device, any other exercise device, and combinations thereof.

In accordance with embodiments of the present disclosure, the translation mechanism 106 may facilitate lateral movement of the display 102 (e.g., the translation mechanism 106 may allow the display 102 to move between a first translational position 112 and a second translational position 114). At the first translational position 112 shown in FIG. 1-1, a display center point 120 of the display 102 may be aligned with a device center point 122 of the entire exercise device 100. At the second translational position 114 shown in FIG. 1-2, the display center point 120 is not aligned with the device center point 122. In some embodiments, the display 102 may change between the first translational position 112 and the second translational position 114 using the translation mechanism 106. In some embodiments, in the second translation position 114, the component does not interfere with rotation of the display from the first rotational position to the second rotational position.

In accordance with embodiments of the present disclosure, the translation mechanism 106 may adjust the translational position of the display 102 using any mechanism. For example, the translation mechanism 106 may include a channel and a rail, such as channel 340 and rail 342 in FIG. 3-1 and FIG. 3-2. In some examples, the translation mechanism may include a slot and a wheel, such as slot 444 and wheel 446 in FIG. 4-1, FIG. 4-2, and FIG. 4-3. In some embodiments, the translation mechanism may include a telescoping arm, such as telescoping arm 548 in FIG. 5-2.

The display 102 may further include a housing 123 having a back wall 124, a bottom side 126 and a side wall 128. In the embodiment shown in FIG. 1-1, FIG. 1-2, and FIG. 1-3, the translation mechanism 106 is connected to the back wall 124 of the display 102. It should be understood however, that in some embodiments, the translation mechanism 106 may be connected to the bottom side 126 or to the side wall 128 of the display 102. In some embodiments, the translation mechanism 106 may allow the display to change translational positions. This may help to adjust the area of the display that is visible to the user from a particular vantage point.

In accordance with embodiments of the present disclosure, the rotation mechanism 108 may allow the display 102 to change rotational position. For example, the display 102 may rotate between the first rotational position 116 shown in FIG. 1-1 and the second rotational position 118 shown in FIG. 1-3. At the first rotational position 116 shown in FIG. 1-1 and FIG. 1-2, the display 102 faces the front view of the exercise device 100. In this manner, as a user performs an exercise activity (such as walking, jogging, or running on the tread belt as it rotates between a front pulley and a rear pulley), the user may view exercise information presented on the display 102. The exercise information may include information about exercise duration, belt speed, incline, distance, graphics or images from a simulated route, calories burned, heart rate, any other exercise information, information from or about other users, and combinations thereof.

In some situations, an exercise program may include one or more activities that the user performs while dismounted from the exercise device 100. For example, the exercise program may include an exercise activity that involves a body weight exercise (e.g., push-ups, sit-ups, pull-ups, dips, stretching, yoga), free-weights, a different exercise device, any other exercise activity, and combinations thereof. The user may dismount the exercise device 100 to a side 129 of the exercise device 100 to perform the exercise activity. When the user dismounts the exercise device 100, he or she may not be able to easily or effectively view information presented on the display 102 while the display is in the position shown in FIG. 1-1 and FIG. 1-2.

In accordance with embodiments of the present disclosure, the display 102 may be rotated to allow the user to view information presented on the display while dismounted from the exercise device. For example, the display 102 may be rotated from the first rotational position 116 shown in FIG. 1-1 and FIG. 1-2 to the second rotational position 118 shown in FIG. 1-3. At the second rotational position 118 shown in FIG. 1-3, the display's 102 side wall 128 faces the front view of the exercise device 100. This may allow a user standing to the side 129 of the exercise device 100 to view the display 102. In this manner, when an exercise program, consisting of multiple exercise activities, includes an exercise activity that the user performs while dismounted from the exercise device 100 (e.g., to the side 129 of the exercise device 100), the user may view exercise information on the display 102. This may improve the exercise experience. In some embodiments, the rotation mechanism 108 may include any rotation mechanism, such as a rod and a pivot bracket.

Some exercise devices may include a component 110, such as one or more handles, that may physically prevent rotation of the display 102. In this situation, the user may not be able to physically rotate the display 102 of the exercise device 100 because the component 110 physically prevents it (e.g., the display 102 may contact the component 110 during rotation). In some situations, if the user is able to rotate the display 102, the display 102 may be at least partially obscured because the component 110 device prevents it by providing a partial visual obstacle. For example, if the user is standing to the side 129 of the exercise device 100, the component 110 may block at least a part of the display 102. The translation mechanism 106 and the rotation mechanism 108 may facilitate both physical rotation and visual viewing of the display 102 without any obstacles. This may allow the user to view exercise information on the display 102 even when he or she is not on the exercise device.

The component 110 of the exercise device 100 may include one or more handles. In the embodiment shown in FIG. 1-1, the one or more components 110 prevent the display 102 physically rotating from the first rotational position 116 to the second rotational position 118 when the display 102 is in the first translational position 112. When the display 102 is moved from first translational position 112 in FIG. 1-1 to the second translational position 114 in FIG. 1-2, the one or more handles may not prevent the display 102 from physically rotating from first rotational position 116 to second rotational position 118. In some embodiments, the component 110 of the exercise device 100 may visually obscure at least a portion of the display 102, or prevent viewing at least a portion of the display 102 in the second rotational position 118, as discussed in further detail herein.

The exercise device frame 104 may further include a post 130 and a base 132. The post 130 may be connected to the base 132 and may support the display 102. The base 132 may comprise a deck 134 and a deck frame 136. In the embodiment shown, the deck 134 includes a tread deck, a front pulley, a rear pulley, and a tread belt extending between the front pulley and the rear pulley. A motor may cause one or both of the front pulley and the rear pulley to rotate, thereby rotating the tread belt. In some embodiments, the base may comprise a bike and a bike frame. In some embodiments, the base may comprise an elliptical and an elliptical frame. The post 130 may extend substantially upright from the base 132. The post 130 may be connected to the rotation mechanism 108.

In some embodiments, the display 102 may include a camera 138. The camera 138 may be configured to record user movements. In some embodiments, the display 102 may visually present the recorded user movements. In some embodiments, presenting the user's movements captured by the camera 138 may allow the user to review his or her form during the exercise activity. In this manner, the user may correct his or her form and thereby improve the exercise experience.

An electrical connection between the frame 104 and the display 102 may be provided through the rotation mechanism 108 and the translation mechanism 106. The electrical wiring may be housed inside of the rotation mechanism 108 and the translation mechanism 106. This way, the electrical wiring may be hidden from plain view. The benefit of hiding the electrical wiring from plain view is that there may be less contact with the wiring, and hence keeping them safe from damage and/or accidental pulling.

FIG. 2-1, FIG. 2-2, and FIG. 2-3 are a representation of an exercise device 200, according to at least one embodiment of the present disclosure. The exercise device 200 includes a display 202, a frame 204, a translation mechanism, a rotation mechanism, and a component 210. In the embodiment shown in FIG. 2-1, FIG. 2-2, and FIG. 2-3, the display 202 may freely rotate using the translation mechanism from the first rotational position 216 shown in FIG. 2-1 to the second rotational position 218 shown in FIG. 2-2. However, as may be seen in FIG. 2-2, after rotating, the component 210 of the exercise device 200 partially obscures a portion of the display 202 or visually prevents viewing of a portion of the display 202 in the second rotational position 218 when the display 202 is in the first translational position 212. In some embodiments, when the display 202 is moved from the first translational position 212 shown in FIG. 2-2 to the second translational position 214 shown in FIG. 2-3, the component 210 of the exercise device 200 may not visually prevent viewing of the display 202. This may allow the user to view exercise information presented on the display 202 while performing an exercise activity to a side of the exercise device.

While embodiments of the present disclosure may show the display 202 as rotating 90°, it should be understood that rotation mechanism may rotate the display 202 by any amount. In some embodiments, the rotation amount may be in a range having an upper value, a lower value, or upper and lower values including any of 15°, 30°, 45°, 60°, 75°, 90°, 105°, 120°, 135°, 150°, 165°, 180°, or any value therebetween. For example, the rotation amount may be greater than 15°. In another example, the rotation amount may be less than 180°. In yet other examples, the rotation amount may be any value in a range between 15° and 180°. In some embodiments, it may be critical that the rotation amount is greater than or equal to 90° to allow the user to view the display while dismounted from the exercise device.

FIGS. 3-1 and 3-2 are representations of a rear view of a translation mechanism 306 of a console 301 of an exercise device 300 according to at least one embodiment of the present disclosure. The exercise device console 301 is supported by a frame 304 and includes a housing 323, a frame 304, a translation mechanism 306, and a component 310. The translation mechanism 306 is configured to translate the display 302 from a first translational position 312 shown in FIG. 3-1 to a second translational position 314 shown in FIG. 3-2. In the embodiment shown in FIG. 3-1 and FIG. 3-2, the translation mechanism 306 includes a channel 340 and a rail 342. The rail 342 is configured to slide inside the channel 340 along a translation axis 341. In the embodiment shown in FIG. 3-1 and FIG. 3-2 the channel 340 is connected to the display 302 and the rail 342 is connected to the frame 304. In some embodiments, the channel 340 may be connected to the frame 304 and the rail 342 may be connected to the display 302. In some embodiments, the translation axis 341 may be transverse (e.g., not parallel) or perpendicular to a rotation axis 364 of the rotation mechanism 308.

In the embodiment shown in FIG. 3-2, the display is translated to the right, however, it should be understood that the display may translate to both the left side and the right side. When the display 302 is translated from a first translational position 312 in FIG. 3-1 to the second translational position 314 in FIG. 3-2, the component 310 is no longer preventing the display 302 from rotating from a first rotational position to a second rotational position (as shown in FIG. 1-2 and FIG. 1-3). In the embodiment shown in FIG. 3-1 and FIG. 3-2, the translation mechanism 306 is connected to the back wall 324 of the display 302, however, in some embodiments, the translation mechanism 306 may be connected to the bottom side 326 of the display 302.

A translation distance is the distance that the console moves along the translation axis 341 from the center position (e.g., the first translational position) shown in FIG. 3-1 to the right translated position (e.g., the second translational position) shown in FIG. 3-2. In some embodiments, the translation distance may be in a range having an upper value, a lower value, or upper and lower values including any of 0.5 in. (1.27 cm), 1.0 in. (2.54 cm), 2.0 in. (5.08 cm), 3.0 in. (7.62 cm), 4.0 in. (10.2 cm), 5.0 in. (12.7 cm), 6.0 in. (15.2 cm), or any value therebetween. For example, the translation distance may be greater than 0.5 in. (1.27 cm). In another example, the translation distance may be less than 6.0 in. (15.2 cm). In yet other examples, the translation distance may be any value in a range between 0.5 in. (1.27 cm) and 6.0 in. (15.2 cm). In some embodiments, it may be critical that the translation distance is greater than 3.0 in. (7.62 cm) to increase the versatility and usability of the console 301.

In some embodiments, wiring 343 for the display 302 may be routed through the post 330. The wiring 343 may connect to the display 302. In some embodiments, the wiring 343 may be connected to a bottom side 326 of the display 302.

This may allow the display 302 to translate and/or rotate without damaging, kinking, or otherwise interfering with the electrical wiring 343.

Figures 1, 4:
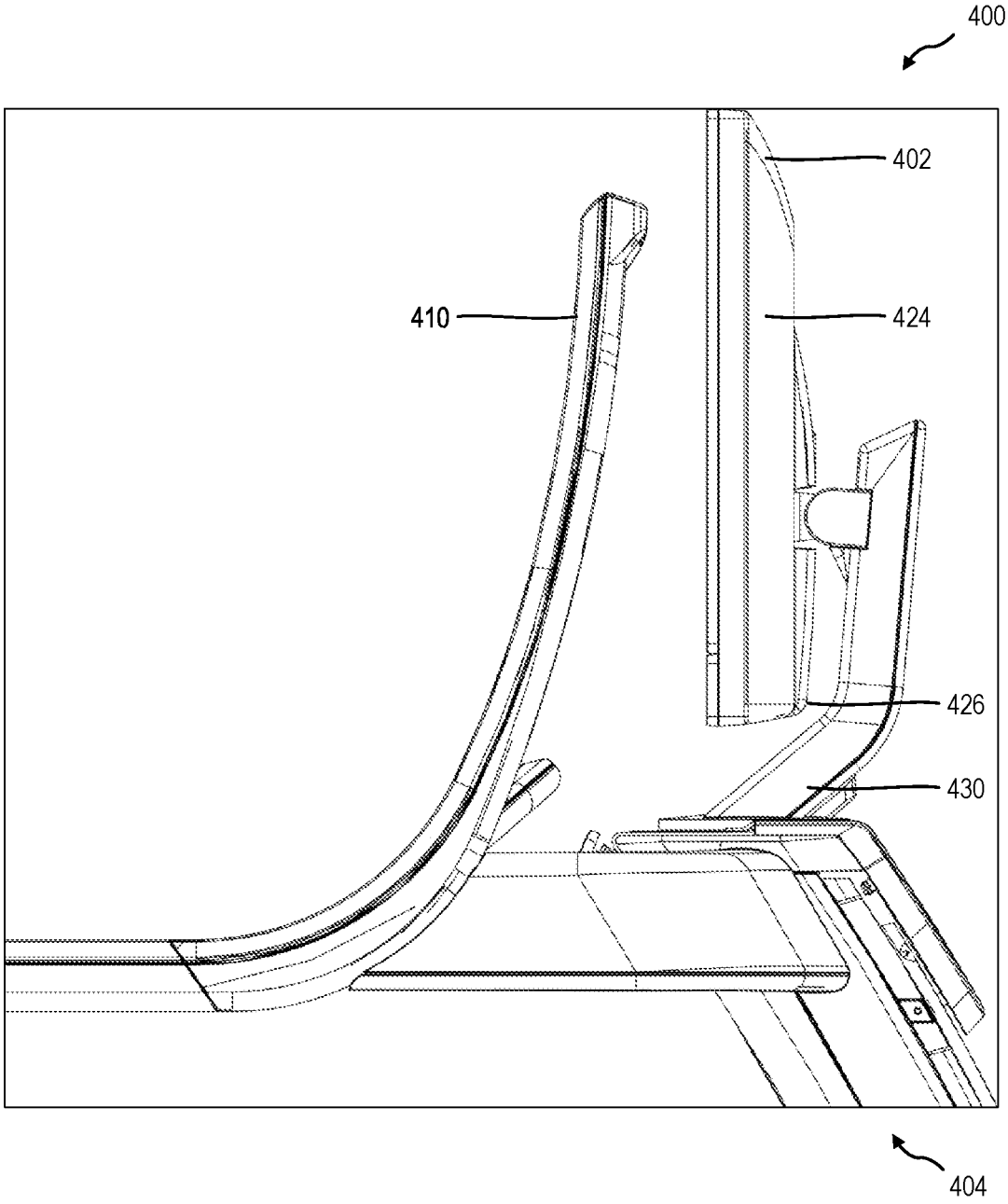
Figures 2, 4:
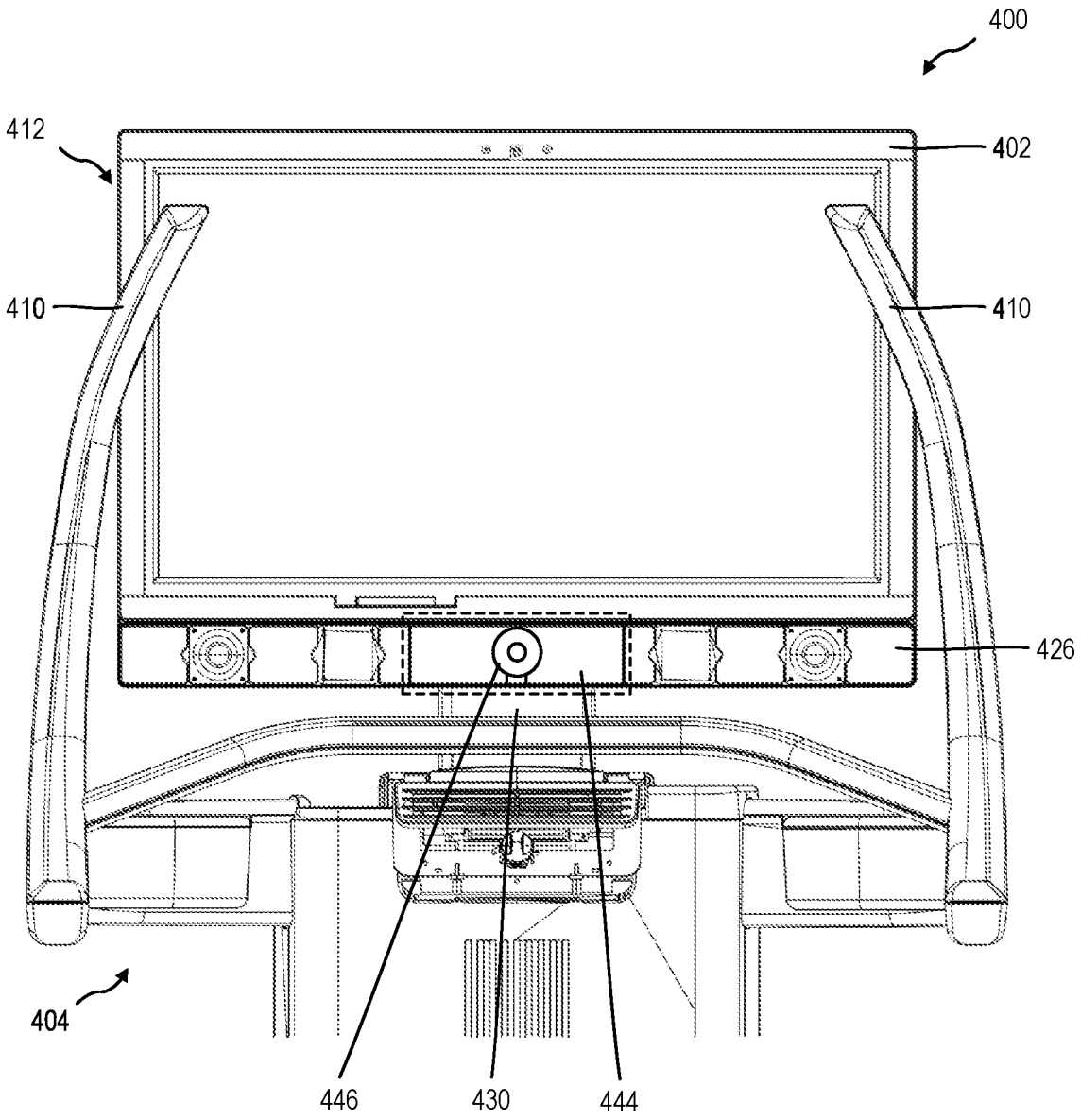
Figures 3, 4:
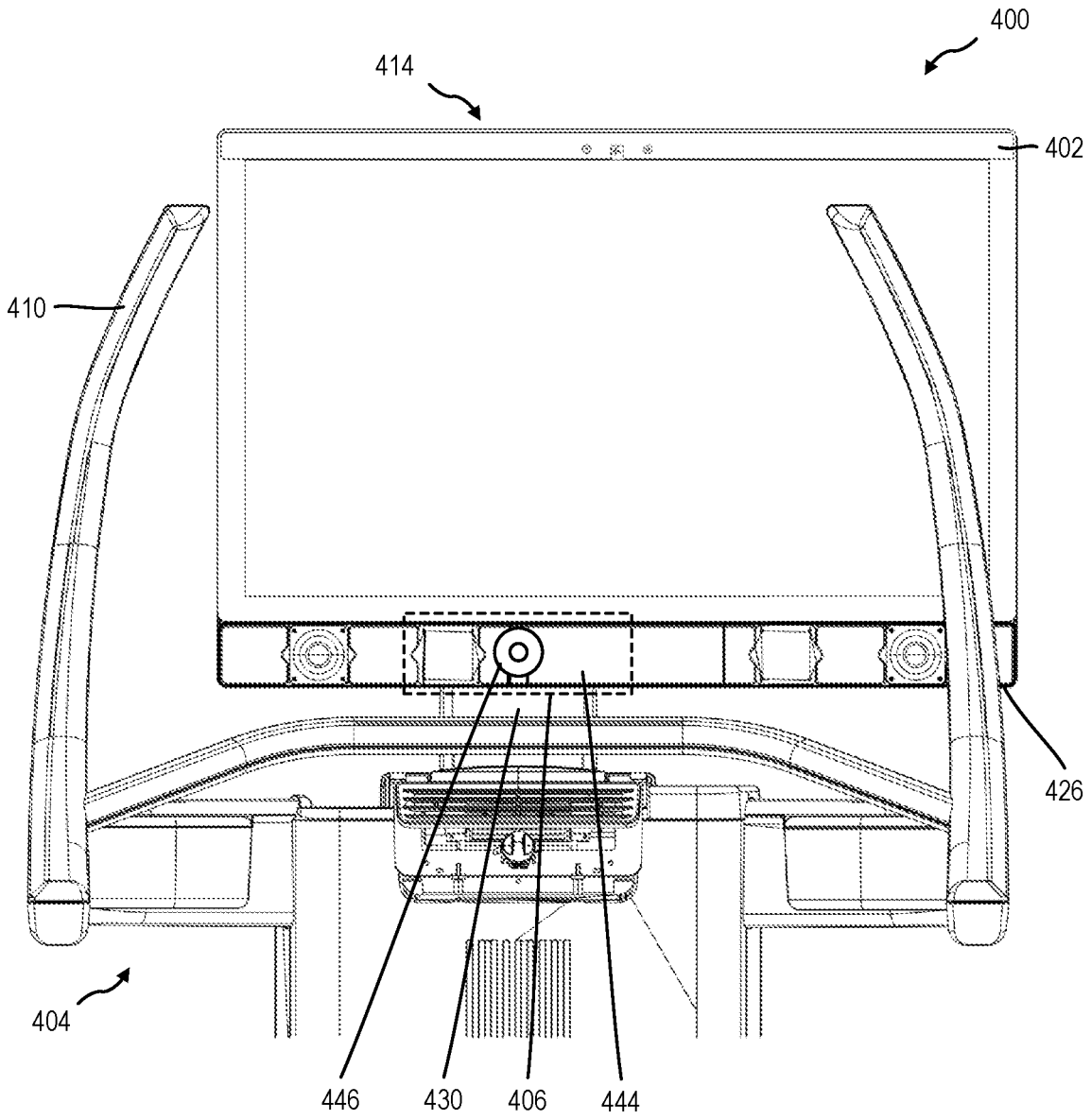

FIG. 4-1 is a side view of an exercise device 400 translation mechanism and FIG. 4-2 and FIG. 4-3 are cross sectional views of the exercise device 400 translation mechanism according to at least one embodiment of the present disclosure. The exercise device 400 includes a display 402, a frame 404, a translation mechanism 406, and a component 410. The translation mechanism 406 is configured to translate the display 402 from a first translational position 412 shown in FIG. 4-2 to a second translational position 414 shown in FIG. 4-3. In the embodiment shown in FIG. 4-1, FIG. 4-2, and FIG. 4-3, the translation mechanism 406 includes a slot 444 and a wheel 446. The wheel 446 is configured to rotate inside the slot 444. The frame 404 may further include a post 430. In the embodiment shown in FIG. 4-2 and FIG. 4-3 the slot 444 is connected to the display 402 and the wheel 446 is connected to the post 430 of the frame 404. In some embodiments, the slot 444 may be connected to the frame 404 and the wheel 446 may be connected to the display 402.

In the embodiment shown in FIG. 4-3, the display 402 is translated to the right, however, it should be understood, that the display 402 may translate to both the left and right side. When the display 402 is translated from a first translational position 412 in FIG. 4-2 to the second translational position 414 in FIG. 4-3, the component 410 is no longer preventing the display from rotating from a first rotational position to a second rotational position (as shown in FIG. 1-2 and FIG. 1-3). In the embodiment shown in FIG. 4-1, FIG. 4-2 and FIG. 4-3, the translation mechanism 406 is connected to the bottom side 426 of the display 402, however, in some embodiments, the translation mechanism 406 may be connected to the back wall 424 of the display 402.

Figures 1, 5:
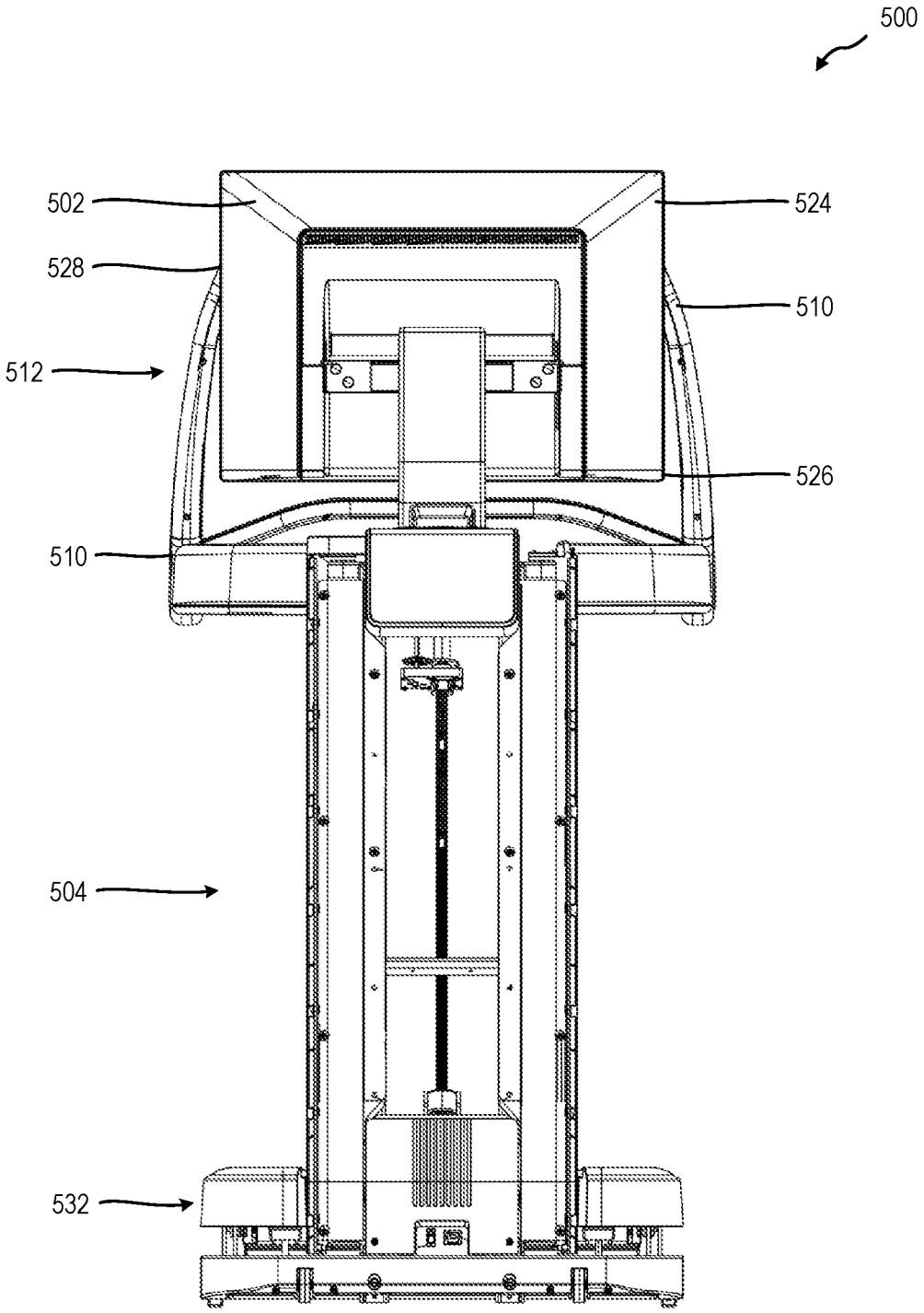
Figures 2, 5:
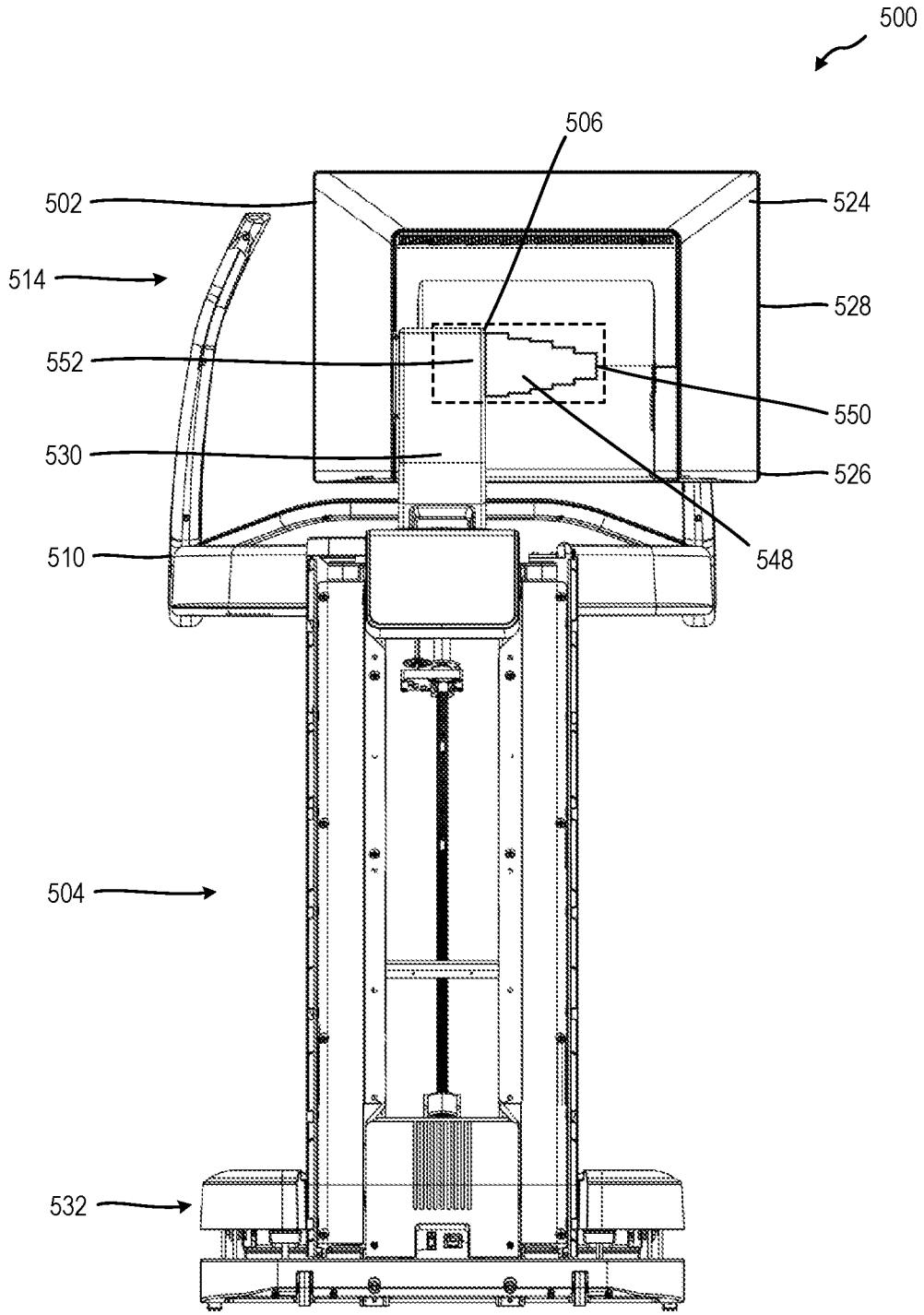

FIG. 5-1 and FIG. 5-2 are back views of a translation mechanism 506 of an exercise device 500, according to at least one embodiment of the present disclosure. The exercise device 500 includes a display 502, a frame 504, a translation mechanism 506, and a component 510. The translation mechanism 506 is configured to translate the display 502 from a first translational position 512 shown in FIG. 5-1 to a second translational position 514 shown in FIG. 5-2. In the embodiment shown in FIG. 5-1 and FIG. 5-2, the translation mechanism 506 includes a telescopic arm 548. The telescopic arm 548 may have a first end 550 and a second end 552 wherein the first end 550 is connected to the display 502 and the second end 552 is connected to the frame 504. The telescopic arm 548 is configured to extend horizontally to move the display 502 laterally. The frame 504 may further include a base 532 and a post 530. The telescopic arm 548 may be connected to the display 502 and to the post 530 of the frame 504.

In the embodiment shown in FIG. 5-2, the display 502 is translated to the right, however, it should be understood, that the display 502 may translate to both the left and right side. When the display 502 is translated from a first translational position 512 in FIG. 5-1 to the second translational position 514 in FIG. 5-2, the component 510 is no longer preventing the display 502 from rotating from a first rotational position to a second rotational position (as shown in FIG. 1-2 and FIG. 1-3). In the embodiment shown in FIG. 5-1 and FIG. 5-2, the translation mechanism 506 is connected to the back wall 524 of the display 502, however, in some embodiments, the translation mechanism 506 may be connected to the bottom side 526 or the side wall 528 of the display 502.

Figure 6:
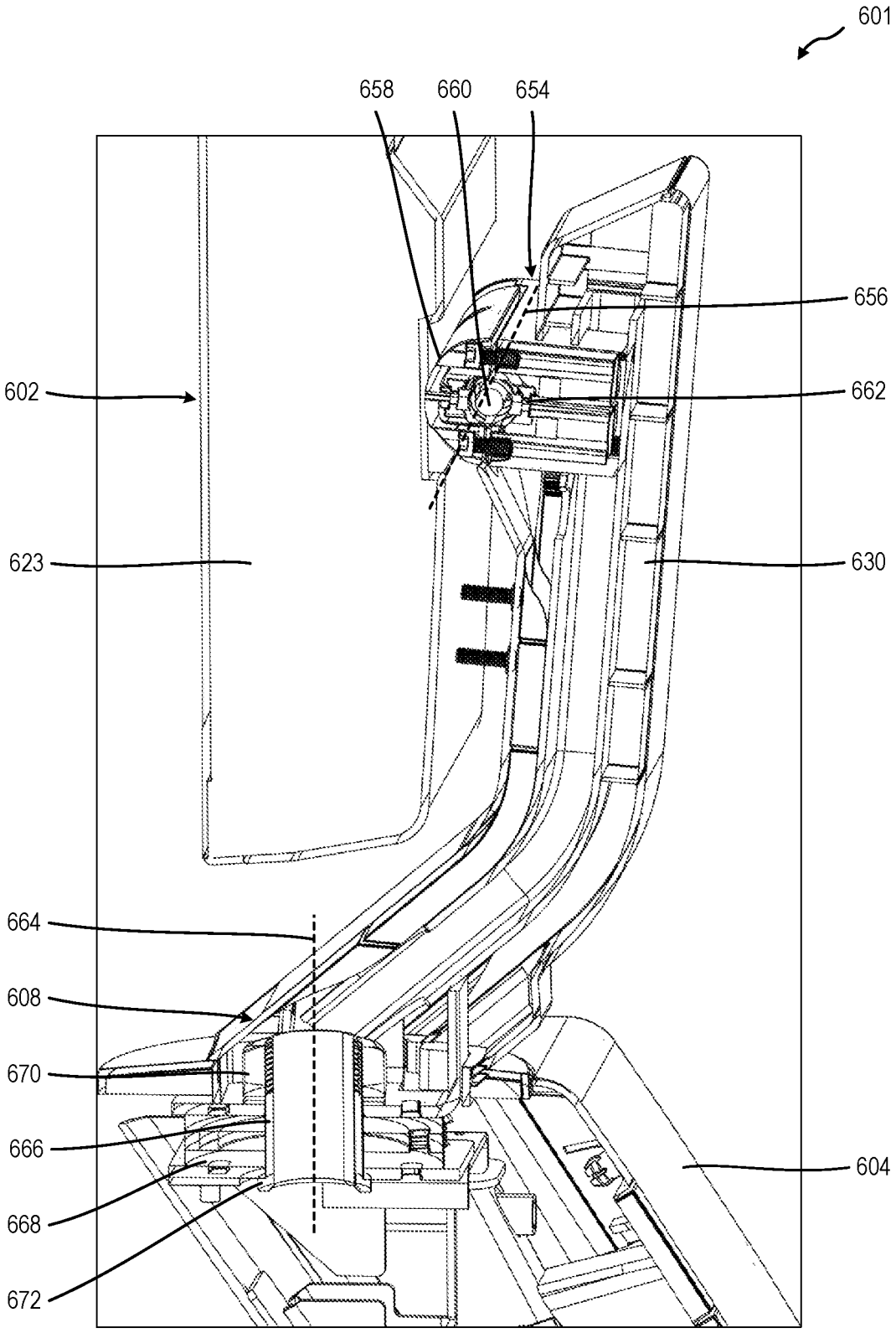
FIG. 6 is a representation of a cross-section of a console, according to at least one embodiment of the present disclosure.

FIG. 6 is a cross-sectional view of a console 601, according to at least one embodiment of the present disclosure. The console 601 includes a pivot mechanism 654. The pivot mechanism 654 may connect a display 602 of the console 601 to a post 630. The post 630 may extend upward from a frame 604 of the exercise device. In some embodiments, the pivot mechanism 654 may allow the console 601 to change a tilt of the display 602 (e.g., an angular position about a pivot axis 656). In some embodiments, the pivot mechanism 654 may adjust the tilt of the console 601 using any mechanism, such as a ball and socket, a telescopic arm, a friction clamp, any other mechanism, and combinations thereof.

In the embodiment shown, the pivot mechanism 654 includes a friction clamp. A pivot housing 658 may be connected to the post 630 and a console housing 623 of the console 601. A pivot rod 660 may be connected to the housing 623. One or more clamping members 662 may surround the pivot rod 660. The clamping members 662 may apply a compressive force to the pivot rod 660. The compressive force may be sufficient to maintain a tilt position of the console 601 while allowing rotation upon application of a force to the console 601.

In some embodiments, the pivot mechanism 654 may include a motor to automatically change the tilt of the console 601. In some embodiments, the motor may be connected to an exercise controller to change the tilt of the console 601 (and therefore the display 602). The exercise controller may change the tilt of the console 601 based on any number of factors, such as a height of the user, a position of the user, an exercise activity, any other factor, and combinations thereof. In some embodiments, the exercise controller may change the tilt of the console 601 based on sensory input, such as a sensed position of the user. The sensory input may be collected from any sensor, such as a weight sensor on the exercise device, a camera on the console 601, any other sensor, and combinations thereof.

A rotation mechanism 608 may connect the post 630 to the frame 604 with a rotary connection. The post 630 may rotate about a rotation axis 664. In some embodiments, the rotation axis 664 may be transverse (e.g., not parallel) or perpendicular to the pivot axis 656. In some embodiments, because the console 601 is connected to the post 630, rotation of the post 630 may rotate the console 601. This may change the viewing angle of the console 601.

The rotation mechanism 608 may include a rod 666 inserted into a pivot bracket 668. The pivot bracket 668 may form a bore into which the rod 666 may be inserted. The rod 666 may be rigidly connected to the post 630. When a force is applied to the console, a torque may be applied to the rod 666, causing the rod 666 to rotate within the bore. In some embodiments, the pivot bracket 668 may include a plurality of plates stacked on top of each other.

In some embodiments, the rod 666 may include a friction clamp with the pivot bracket 668. The friction clamp may include a nut 670 threaded onto the rod 666. The opposite end of the rod 666 may include a lip 672. The rod 666 may be clamped to the pivot bracket 668 by tightening the nut 670 on the rod 666. In some embodiments, the clamping force may be strong enough to maintain the rotational position of the post 630 while still allowing the post 630 and the console 601 to rotate based on the application of a force.

In some embodiments, the rotation mechanism 608 may include a motor to automatically change the rotational position of the post 630 and the console 601. In some embodiments, the motor may be connected to an exercise controller to change the rotational position of the console 601 (and therefore the display 602). The exercise controller may change the rotational position of the console 601 based on any number of factors, a position of the user, an exercise activity, any other factor, and combinations thereof. In some embodiments, the exercise controller may change the tilt of the console 601 based on sensory input, such as a sensed position of the user. The sensory input may be collected from any sensor, such as a weight sensor on the exercise device, a camera on the console 601, any other sensor, and combinations thereof.

Figure 7:
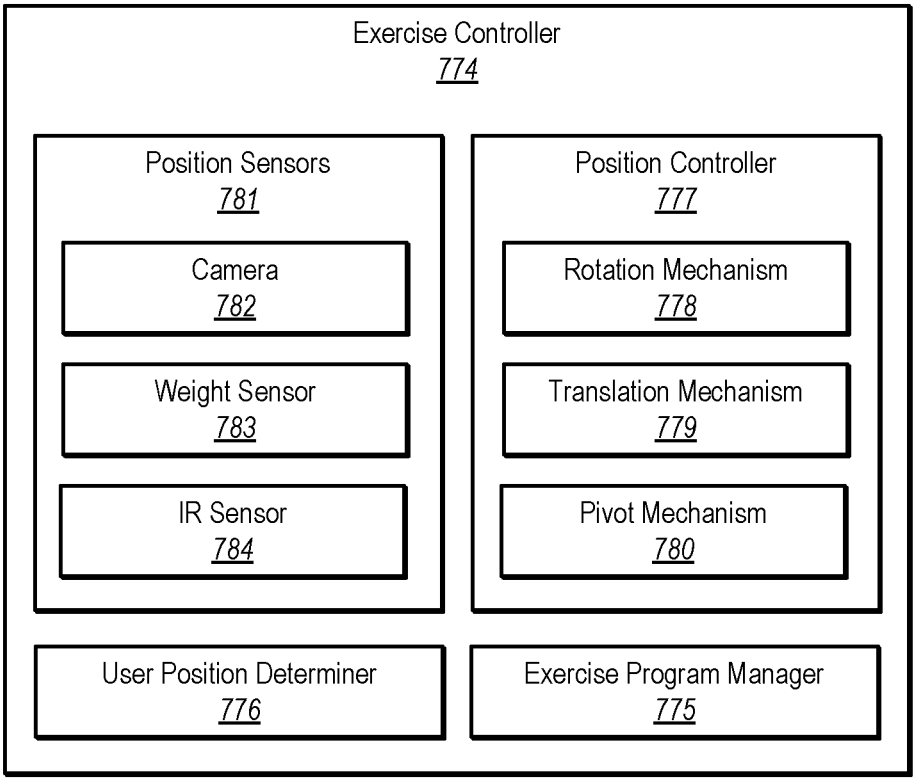
FIG. 7 is a representation of an exercise controller, according to at least one embodiment of the present disclosure.

FIG. 7 is a representation of an exercise controller 774, according to at least one embodiment of the present disclosure. The exercise controller 774 may control the operation of an exercise device. In some embodiments, the exercise controller 774 may include an exercise program manager 775. The exercise program manager 775 may execute an exercise program. The exercise program may include one or more exercise activities. The exercise program manager 775 may adjust one or more settings of an exercise device based on the exercise program, such as a resistance level, an incline, a speed, or other setting.

In some embodiments, the exercise program may include one or more activities that the user may perform while dismounted from the exercise device. In some embodiments, the exercise program manager 775 may instruct the user to dismount the exercise device and begin the activity. In some embodiments, the exercise controller 774 may include a user position determiner 776. The user position determiner 776 may determine the position of the user. Based on the position of the user, a position controller 777 may adjust a position of the console to direct the display toward the user.

In some embodiments, the user position determiner 776 may utilize information from one or more position sensors 781. The position sensors may be used to determine the position of the user, and may include a camera 782, a weight sensor 783, an IR sensor 784, any other sensor, and combinations thereof.

To change the position of the console, the position controller 777 may operate one or more console position mechanisms. Each of the position mechanisms may be operated using one or more motors. The position controller 777 may operate a rotation mechanism 778, a translation mechanism 779, and/or a pivot mechanism 780. In some embodiments, the position controller 777 may adjust each of the position mechanisms so that the display of the console faces the user.

During implementation of the exercise program, the exercise program manager 775 may provide instructions to the user to dismount the exercise device to perform an exercise activity. In some embodiments, the user position determiner 776 may determine the position of the user based on the user activity. For example, the exercise device may be located next to a free weight rack, and the exercise activity may involve free weights. The location of the free weight rack may be programmed into the user position determiner 776. In this manner, the position controller 777 may change the position of the console based on the exercise activity implemented by the exercise program manager 775. In some embodiments, the user position determiner 776 may determine the position of the user using a combination of exercise activity and information provided by the position sensors 781.

Figure 8:
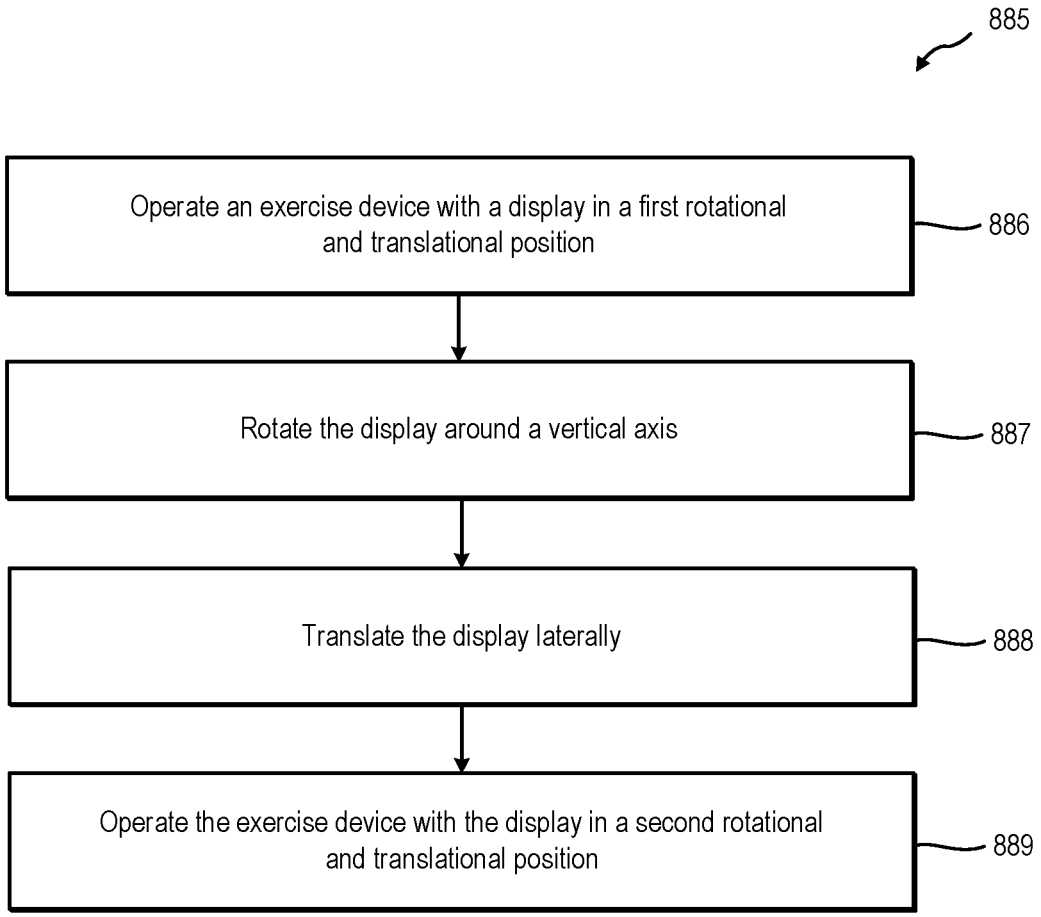
FIG. 8 is a representation of a method for operating an exercise device, according to at least one embodiment of the present disclosure.

FIG. 8 is a representation of a method 885 for operating an exercise device, according to at least one embodiment of the present disclosure. The method 885 includes operating the exercise device with the display in a first rotational position and a first translational position at 886. The display may be rotated around a vertical axis to a second rotational position at 887. A component of the exercise device may prevent viewing of the display in the second rotational position and the first translational position. The display may be translated laterally from the first translational position to a second translational position at 888. The exercise device may be operated with the display in the second rotational position and the second translational position at 889. In some embodiments, operating the exercise device may include performing an exercise activity to the side of the exercise device. In some embodiments, operating the exercise device may include displaying exercise information on the display. In some embodiments, operating the exercise device may include providing instruction to a user to perform an exercise activity while dismounted from the exercise device. The component of the exercise device may not prevent viewing of the display in the second rotational position and the second translational position.

INDUSTRIAL APPLICABILITY

This disclosure generally relates to an exercise device having a movable display. An exercise device can simulate a personal trainer giving instructions to a user. These instructions can be provided to the user via a display. The instructions may include one or more activities that are not performed using the exercise device, or which may involve the user dismounting the exercise device and performing the activity in a space around the exercise device. For example, the user might be positioned on the side of the exercise device while doing exercises instructed by the exercise device display, such as stretching, strength training, weight-lifting, and so forth. When the user dismounts the exercise device, he or she may not be able to see the display of the exercise device while standing away from of the exercise device. In accordance with embodiments of the present disclosure, the display may be rotated from facing the exercise device to facing the space where the user is performing the exercise activity. This may allow the user to view the display and utilize the exercise information presented thereon more easily.

In some embodiments, an exercise device includes a console having a display, a frame, a translation mechanism, a rotation mechanism, and a component. In accordance with embodiments of the present disclosure, the console may be a movable console. Put another way, the movable console may change translational position, rotational position, and/or tilt position to face the user, thereby allowing the user to view exercise information on the display while performing exercise activities while dismounted from the exercise device. In some embodiments, the exercise device is a treadmill. However, it should be understood that the exercise device may be any type of exercise device, such as an elliptical device, an exercise bike, a rower, a cable resistance device, any other exercise device, and combinations thereof.

In accordance with embodiments of the present disclosure, the translation mechanism may facilitate lateral movement of the display (e.g., the translation mechanism may allow the display to move between a first translational position and a second translational position). At the first translational position, a display center point of the display may be aligned with the device center point of the entire exercise device. At the second translational position, the display center point is not aligned with the device center point. In some embodiments, the display may change between the first translational position and the second translational position using the translation mechanism. In some embodiments, in the second translation position, the component does not interfere with rotation of the display from the first rotational position to the second rotational position.

In accordance with embodiments of the present disclosure, the translation mechanism may adjust the translational position of the display using any mechanism. For example, the translation mechanism may include a channel and a rail. In some examples, the translation mechanism may include a slot and a wheel. In some embodiments, the translation mechanism may include a telescoping arm.

The display may further include a housing having a back wall, a bottom side, and a side wall. In some embodiments, the translation mechanism is connected to the back wall of the display. It should be understood however, that in some embodiments, the translation mechanism may be connected to the bottom side or to the side wall of the display. In some embodiments, the translation mechanism may allow the display to change translational positions. This may help to adjust the area of the display that is visible to the user from a particular vantage point.

In accordance with embodiments of the present disclosure, the rotation mechanism may allow the display to change rotational position. For example, the display may rotate between the first rotational position and the second rotational position. At the first rotational position the display faces the front view of the exercise device. In this manner, as a user performs an exercise activity (such as walking, jogging, or running on the tread belt as it rotates between a front pulley and a rear pulley), the user may view exercise information presented on the display. The exercise information may include information about exercise duration, belt speed, incline, distance, graphics or images from a simulated route, calories burned, heart rate, any other exercise information, information from or about other users, and combinations thereof.

In some situations, an exercise program may include one or more activities that the user performs while dismounted from the exercise device. For example, the exercise program may include an exercise activity that involves a body weight exercise (e.g., push-ups, sit-ups, pull-ups, dips, stretching, yoga), free-weights, a different exercise device, any other exercise activity, and combinations thereof. The user may dismount the exercise device to a side of the exercise device to perform the exercise activity. When the user dismounts the exercise device, he or she may not be able to easily or effectively view information presented on the display.

In accordance with embodiments of the present disclosure, the display may be rotated to allow the user to view information presented on the display while dismounted from the exercise device. For example, the display may be rotated from the first rotational position to the second rotational position. At the second rotational position, the display's side wall faces the front view of the exercise device. This may allow a user standing to the side of exercise device to view the display. In this manner, when an exercise program, consisting of multiple exercise activities, includes an exercise activity that the user performs while dismounted from the exercise device (e.g., to the side of the exercise device), the user may view exercise information on the display. This may improve the exercise experience. In some embodiments, the rotation mechanism may include any rotation mechanism, such as a rod and a pivot bracket.

Some exercise devices may include a component, such as one or more handles, that may physically prevent rotation of the display. In this situation, the user may not be able to physically rotate the display of the exercise device because the component physically prevents it (e.g., the display may contact the component during rotation). In some situations, if the user is able to rotate the display, the display may be at least partially obscured because the component device prevents it by providing a partial visual obstacle. For example, if the user is standing to the side of the exercise device, the component may block at least a part of the display. The translation mechanism and the rotation mechanism may facilitate both physical rotation and visual viewing of the display without any obstacles. This may allow the user to view exercise information on the display even when he or she is not on the exercise device.

The component of the exercise device may include one or more handles. In some embodiments, the one or more components prevent the display physically rotating from first rotational position to second rotational position when the display is in the first translational position. When the display is moved from first translational position to the second translational position, the one or more handles may not prevent the display from physically rotating from first rotational position to second rotational position. In some embodiments, the component of the exercise device may visually obscure at least a portion of the display or prevent viewing at least a portion of the display in the second rotational position, as discussed in further detail herein.

The exercise device frame may further include a post and a base. The post may be connected to the base and may support the display. The base may comprise a deck and a deck frame. In some embodiments, the deck includes a tread deck, a front pulley, a rear pulley, and a tread belt extending between the front pulley and the rear pulley. A motor may cause one or both of the front pulley and the rear pulley to rotate, thereby rotating the tread belt. In some embodiments, the base may comprise a bike and a bike frame. In some embodiments, the base may comprise an elliptical and an elliptical frame. The post may extend substantially upright from the base. The post may be connected to the rotation mechanism.

In some embodiments, the display may include a camera. The camera may be configured to record user movements. In some embodiments, the display may visually present the recorded user movements. In some embodiments, presenting the user's movements captured by the camera may allow the user to review his or her form during the exercise activity. In this manner, the user may correct his or her form and thereby improve the exercise experience.

An electrical connection between the frame and the display may be provided through the rotation mechanism and the translation mechanism. The electrical wiring may be housed inside of the rotation mechanism and the translation mechanism. This way, the electrical wiring may be hidden from plain view. The benefit of hiding the electrical wiring from plain view is that there may be less contact with the wiring, and hence keeping them safe from damage and/or accidental pulling.

In some embodiments, an exercise device includes a display, a frame, a translation mechanism, a rotation mechanism, and a component. In some embodiments, the display may freely rotate using the translation mechanism from the first rotational position to the second rotational position. However, after rotating, the component of the exercise device partially obscures a portion of the display or visually prevents viewing of a portion of the display in the second rotational position when the display is in the first translational position. In some embodiments, when the display is moved from the first translational position to the second translational position, the component of the exercise device may not visually prevent viewing of the display. This may allow the user to view exercise information presented on the display while performing an exercise activity to a side of the exercise device.

While embodiments of the present disclosure may discuss the display as rotating 90°, it should be understood that rotation mechanism may rotate the display by any amount. In some embodiments, the rotation amount may be in a range having an upper value, a lower value, or upper and lower values including any of 15°, 30°, 45°, 60°, 75°, 90°, 105°, 120°, 135°, 150°, 165°, 180°, or any value therebetween. For example, the rotation amount may be greater than 15°. In another example, the rotation amount may be less than 180°. In yet other examples, the rotation amount may be any value in a range between 15° and 180°. In some embodiments, it may be critical that the rotation amount is greater than or equal to 90° to allow the user to view the display while dismounted from the exercise device.

In some embodiments, an exercise device console is supported by a frame and includes a housing, a frame, a translation mechanism, and a component. The translation mechanism is configured to translate the display from a first translational position to a second translational position. In some embodiments, the translation mechanism includes a channel and a rail. The rail is configured to slide inside the channel along a translation axis. In some embodiments, the channel is connected to the display and the rail is connected to the frame. In some embodiments, the channel may be connected to the frame and the rail may be connected to the display. In some embodiments, the translation axis may be transverse (e.g., not parallel) or perpendicular to a rotation axis of the rotation mechanism.

In some embodiments discussed herein, the display is translated to the right, however, it should be understood that the display may translate to both the left and right side. When the display is translated from a first translational position to the second translational position, the component is no longer preventing the display from rotating from a first rotational position to a second rotational position. In some embodiments, the translation mechanism is connected to the back wall of the display, however, in some embodiments, the translation mechanism may be connected to the bottom side of the display.

A translation distance is the distance that the console moves along the translation axis from the center position (e.g., the first translational position) to the right translated position (e.g., the second translational position). In some embodiments, the translation distance may be in a range having an upper value, a lower value, or upper and lower values including any of 0.5 in. (1.27 cm), 1.0 in. (2.54 cm), 2.0 in. (5.08 cm), 3.0 in. (7.62 cm), 4.0 in. (10.2 cm), 5.0 in. (12.7 cm), 6.0 in. (15.2 cm), or any value therebetween. For example, the translation distance may be greater than 0.5 in. (1.27 cm). In another example, the translation distance may be less than 6.0 in. (15.2 cm). In yet other examples, the translation distance may be any value in a range between 0.5 in. (1.27 cm) and 6.0 in. (15.2 cm). In some embodiments, it may be critical that the translation distance is greater than 3.0 in. (7.62 cm) to increase the versatility and usability of the console.

In some embodiments, wiring for the display may be routed through the post. The wiring may connect to the display. In some embodiments, the wiring may be connected to a bottom side of the display. This may allow the display to translate and/or rotate without damaging, kinking, or otherwise interfering with the electrical wiring.

In some embodiments, an exercise device includes a display, a frame, a translation mechanism, and a component. The translation mechanism is configured to translate the display from a first translational position to a second translational position. In some embodiments, the translation mechanism includes a slot and a wheel. The wheel is configured to rotate inside the slot. The frame may further include a base and a post. In some embodiments, the slot is connected to the display and the wheel is connected to the post of the frame. In some embodiments, the slot may be connected to the frame and the wheel may be connected to the display.

In some embodiments, the display is translated to the right, however, it should be understood that the display may translate to both the left and right side. When the display is translated from a first translational position to the second translational position, the component is no longer preventing the display from rotating from a first rotational position to a second rotational position. In some embodiments, the translation mechanism is connected to the bottom side of the display, however, in some embodiments, the translation mechanism may be connected to the back wall of the display.

In some embodiments, an exercise device includes a display, a frame, a translation mechanism, and a component. The translation mechanism is configured to translate the display from a first translational position to a second translational position. In some embodiments, the translation mechanism includes a telescopic arm. The telescopic arm may have a first end and a second end wherein the first end is connected to the display and the second end is connected to the frame. The telescopic arm is configured to extend horizontally to move the display laterally. The frame may further include a base and a post. The telescopic arm may be connected to the display and to the post of the frame.

In some embodiments, the display is translated to the right, however, it should be understood, that the display may translate to both the left and right side. When the display is translated from a first translational position to the second translational position, the component is no longer preventing the display from rotating from a first rotational position to a second rotational position. In some embodiments, the translation mechanism is connected to the back wall of the display, however, in some embodiments, the translation mechanism may be connected to the bottom side or the side wall of the display.

In some embodiments, a console includes a pivot mechanism. The pivot mechanism may connect a display of the console to a post. The post may extend upward from a frame of the exercise device. In some embodiments, the pivot mechanism may allow the console to change a tilt of the display (e.g., an angular position about a pivot axis). In some embodiments, the pivot mechanism may adjust the tilt of the console using any mechanism, such as a ball and socket, a telescopic arm, a friction clamp, any other mechanism, and combinations thereof.

In the embodiment shown, the pivot mechanism includes a friction clamp. A pivot housing may be connected to the post and a console housing of the console. A pivot rod may be connected to the housing. One or more clamping members may surround the pivot rod. The clamping members may apply a compressive force to the pivot rod. The compressive force may be sufficient to maintain a tilt position of the console while allowing rotation upon application of a force to the console.

In some embodiments, the pivot mechanism may include a motor to automatically change the tilt of the console. In some embodiments, the motor may be connected to an exercise controller to change the tilt of the console (and therefore the display). The exercise controller may change the tilt of the console based on any number of factors, such as a height of the user, a position of the user, an exercise activity, any other factor, and combinations thereof. In some embodiments, the exercise controller may change the tilt of the console based on sensory input, such as a sensed position of the user. The sensory input may be collected from any sensor, such as a weight sensor on the exercise device, a camera on the console, any other sensor, and combinations thereof.

A rotation mechanism may connect the post to the frame with a rotary connection. The post may rotate about a rotation axis. In some embodiments, the rotation axis may be transverse (e.g., not parallel) or perpendicular to the pivot axis. In some embodiments, because the console is connected to the post, rotation of the post may rotate the console. This may change the viewing angle of the console.

The rotation mechanism may include a rod inserted into a pivot bracket. The pivot bracket may form a bore into which the rod may be inserted. The rod may be rigidly connected to the post. When a force is applied to the console, a torque may be applied to the rod, causing the rod to rotate within the bore. In some embodiments, the pivot bracket may include a plurality of plates stacked on top of each other.

In some embodiments, the rod may include a friction clamp with the pivot bracket. The friction clamp may include a nut threaded onto the rod. The opposite end of the rod may include a lip. The rod may be clamped to the pivot bracket by tightening the nut on the rod. In some embodiments, the clamping force may be strong enough to maintain the rotational position of the post while still allowing the post and the console to rotate based on the application of a force.

In some embodiments, the rotation mechanism may include a motor to automatically change the rotational position of the post and the console. In some embodiments, the motor may be connected to an exercise controller to change the rotational position of the console (and therefore the display). The exercise controller may change the rotational position of the console based on any number of factors, a position of the user, an exercise activity, any other factor, and combinations thereof. In some embodiments, the exercise controller may change the tilt of the console based on sensory input, such as a sensed position of the user. The sensory input may be collected from any sensor, such as a weight sensor on the exercise device, a camera on the console, any other sensor, and combinations thereof.

In some embodiments, an exercise controller may control the operation of an exercise device. In some embodiments, the exercise controller may include an exercise program manager. The exercise program manager may execute an exercise program. The exercise program may include one or more exercise activities. The exercise program manager may adjust one or more settings of an exercise device based on the exercise program, such as a resistance level, an incline, a speed, or other setting.

In some embodiments, the exercise program may include one or more activities that the user may perform while dismounted from the exercise device. In some embodiments, the exercise program manager may instruct the user to dismount the exercise device and begin the activity. In some embodiments, the exercise controller may include a user position determiner. The user position determiner may determine the position of the user. Based on the position of the user, a position controller may adjust a position of the console to direct the display toward the user.

In some embodiments, the user position determiner may utilize information from one or more position sensors. The position sensors may be used to determine the position of the user, and may include a camera, a weight sensor, an IR sensor, any other sensor, and combinations thereof.

To change the position of the console, the position controller may operate one or more console position mechanisms. Each of the position mechanisms may be operated using one or more motors. The position controller may operate a rotation mechanism, a translation mechanism, and/or a pivot mechanism. In some embodiments, the position controller may adjust each of the position mechanisms so that the display of the console faces the user.

During implementation of the exercise program, the exercise program manager may provide instructions to the user to dismount the exercise device to perform an exercise activity. In some embodiments, the user position determiner may determine the position of the user based on the user activity. For example, the exercise device may be located next to a free weight rack, and the exercise activity may involve free weights. The location of the free weight rack may be programmed into the user position determiner. In this manner, the position controller may change the position of the console based on the exercise activity implemented by the exercise program manager. In some embodiments, the user position determiner may determine the position of the user using a combination of exercise activity and information provided by the position sensors.

In some embodiments, a method includes operating the exercise device with the display in a first rotational position and a first translational position. The display may be rotated around a vertical axis to a second rotational position. A component of the exercise device may prevent viewing of the display in the second rotational position and the first translational position. The display may be translated laterally from the first translational position to a second translational position. The exercise device may be operated with the display in the second rotational position and the second translational position. The component of the exercise device may not prevent viewing of the display in the second rotational position and the second translational position.

Following are sections in accordance with embodiments of the present disclosure:

A1. An exercise device, comprising;

a. a frame;

b. a display movably connected to the frame between a first rotational position, a second rotational position, a first translational position, and a second translational position;

c. a translation mechanism, wherein the display is movable between the first translational position and the second translational position using the translation mechanism;

d. a rotation mechanism, wherein the display is movable between the first rotational position and the second rotational position using the rotation mechanism;

e. a component connected to the frame and positioned to physically prevent rotation of the display to the second rotational position when the display is in the first rotational position and the first translational position or visually obscure at least a portion of the display when the display is in the second rotational position and the first translational position, wherein, when the display is in the second translational position, the component does not interfere with rotation of the display from the first rotational position to the second rotational position nor obscure the portion of the display when the display is in the second rotational position.

A2. The exercise device of section A1, wherein the translation mechanism facilitates lateral movement of the display between the first translational position and the second translational position.

A3. The exercise device of section A1 or A2, wherein, in the first translational position, a display center point is aligned with a device center point of the exercise device.

A4. The exercise device of any of sections A1-A3, wherein, in the second translational position, a display center point is not aligned with a device center point of the exercise device.

A5. The exercise device of any of sections A1-A4, wherein the translation mechanism includes a motor to move the display from the first translational position to the second translational position.

A6. The exercise device of any of sections A1-A5, wherein the translation mechanism includes a channel and a rail.

A7. The exercise device of section A6, wherein the rail is configured to slide inside of the channel.

A8. The exercise device of section A6 or A7, wherein the channel is connected to the display and the rail is connected to the frame.

A9. The exercise device of any of sections A6-A8, wherein the channel is connected to the frame and the rail is connected to the display.

A10. The exercise device of any of sections A1-A9, wherein the translation mechanism includes a slot and a wheel.

A11. The exercise device of section A10, wherein the wheel is configured to spin inside of the slot.

A12. The exercise device of section A10 or A11, wherein the slot is connected to the display and the wheel is connected to the frame.

A13. The exercise device of any of sections A10-A12, wherein the slot is connected to the frame and the wheel is connected to the display.

A14. The exercise device of any of sections A1-A13, wherein the translation mechanism includes a telescoping arm.

A15. The exercise device of section A14, wherein the telescoping arm is configured to extend horizontally.

A16. The exercise device of section A14 or A15, wherein the telescoping arm includes a first end and a second end, wherein the first end is connected to the display and the second end is connected to the frame.

A17. The exercise device of any of sections A1-A16, wherein the display includes a back wall, a bottom side, and a side wall.

A18. The exercise device of section A17, wherein the translation mechanism is connected to the back wall of the display.

A19. The exercise device of section A17 or A18, wherein the translation mechanism is connected to the bottom side of the display.

A20. The exercise device of any of sections A17-A19, wherein the translation mechanism is connected to the side wall of the display.

A21. The exercise device of any of sections A1-A20, further comprising a pivot mechanism, wherein the pivot mechanism is connected to the display.

A22. The exercise device of section A21, wherein the pivot mechanism includes a ball and a socket.

A23. The exercise device of section A22, wherein the ball is configured to move relative to the socket.

A24. The exercise device of any of sections A21-A23, wherein the pivot mechanism includes a telescopic arm.

A25. The exercise device of any of sections A21-A24, wherein the pivot mechanism includes a motor to change a tilt of the display.

A26. The exercise device of any of sections A1-A25, wherein the rotation mechanism includes a motor to move the display between the first rotational position and the second rotational position.

A27. The exercise device of any of sections A1-A26, wherein the rotation mechanism includes a rod and a pivot bracket.

A28. The exercise device of section A27, wherein the rod includes a first end and a second end.

A29. The exercise device of section A28, wherein the first end of the rod is configured to sit and rotate inside of the pivot bracket.

A30. The exercise device of any of sections A27-A29, wherein the rod is connected to the frame and the pivot bracket is connected to the display.

A31. The exercise device of any of sections A27-A30, wherein the rod is connected to the display and the pivot bracket is connected to the frame.

A32. The exercise device of any of sections A1-A31, wherein the component prevents more than 45° of rotation when the display is in the first translation position.

A33. The exercise device of any of sections A1-A32, wherein the second rotational position is approximately 90° from the first rotational position.

A34. The exercise device of any of sections A1-A33, wherein the second rotational position is between 60° and 180° from the first rotational position.

A35. The exercise device of any of sections A1-A34, further including a camera.

A36. The exercise device of section A35, wherein the camera is connected to the display.

A37. The exercise device of section A35 or A36, wherein the camera is configured to record user movements.

A38. The exercise device of section A37, wherein the display is configured to visually present the recorded user movements on the display.

A39. The exercise device of any of sections A1-A38, wherein the component of the exercise device includes one or more handles.

A40. The exercise device of any of sections A1-A39, wherein the exercise device is a treadmill.

A41. The exercise device of any of sections A1-A40, wherein the exercise device is an elliptical device.

A42. The exercise device of any of sections A1-A41, wherein the exercise device is an exercise bike.

A43. The exercise device of any of sections A1-A42, wherein the frame further includes an arm and a base.

A44. The exercise device of section A43, wherein the arm extends substantially upright from the base.

A45. The exercise device of section A43 or A44, wherein the arm is connected to the rotation mechanism.

A46. The exercise device of section A45, wherein the rotation mechanism includes a rod and a pivot bracket.

A47. The exercise device of section A46, wherein the rod is connected to the arm and the pivot bracket is connected to the display.

A48. The exercise device of section A46 or A47, wherein the rod is connected to the display and the pivot bracket is connected to the arm.

A49. The exercise device of any of sections A1-A48, wherein, in the first rotational position, the display faces an operating surface of the exercise device, and in the second rotational position, the display faces away from an operating surface of the exercise device.

A50. The exercise device of section A49, wherein, in the second rotational position, the display is perpendicular to the operating surface.

A51. The exercise device of section A49 or A50, wherein, in the second rotational position, the display faces opposite the operating surface of the exercise device.

A52. The exercise device of any of sections A1-A52, further including an electrical wiring, wherein the electrical wiring between the frame and the display travels through the translation mechanism and the rotation mechanism.

B1. A movable console for exercise device, comprising;

a. a housing;

b. a display in the housing;

c. an upright post connecting the housing to a frame of the exercise device;

d. a translation mechanism connecting the housing to the upright post, wherein the housing is laterally slidable along a translation axis along the translation mechanism; and e. a rotation mechanism connecting the upright post to the frame, wherein the housing is rotationally slidable with the rotation mechanism about a rotation axis, wherein the translation axis is transverse to the translation axis.

B2. The movable console of section B1, wherein a component of the exercise device interferes with rotation of the housing in one or more translation positions.

B3. The movable console of section B1 or B2, wherein a component of the exercise device visually obscures at least a portion of the display in one or more translation positions.

B4. The movable console of any of sections B1-B3, further comprising a pivot mechanism at the housing, wherein the housing is rotatable about the pivot mechanism to adjust a tilt of the housing.

B5. The movable console of section B4, wherein the housing is rotatable about a pivot axis of the pivot housing, and wherein the pivot axis is parallel to the translation axis.

B6. The movable console of any of sections B1-B5, wherein the translation axis is perpendicular to the rotation axis.

B7. The movable console of any of sections B1-B6, wherein the rotation axis is parallel to a force of gravity.

B8. The movable console of any of sections B1-B7, wherein the translation mechanism has a range of movement of about 4 in.

B9. The movable console of any of sections B1-B8, wherein the rotation mechanism has a range of movement of about 180°.

B10. The movable console of any of sections B1-B9, wherein the rotation mechanism rotates the upright post.

B11. The movable console of any of sections B1-B10, wherein the translation mechanism translates the upright post.

C1. A method for operating an exercise device, comprising;

a. operating the exercise device with a display in a first rotational position and a first translational position;

b. rotating the display around a vertical axis to a second rotational position, wherein a component of the exercise device prevents viewing the display in the second rotational position and the first translational position; and c. translating the display laterally from the first translational position to a second translational position; and d. operating the exercise device with the display in the second rotational position and second translational position, wherein the component of the exercise device does not prevent viewing the display in the second rotational position and the second translational position.

C2. The method of section C1, wherein the component of the exercise device obscures at least a portion of the exercise device to a user standing to a lateral side of the exercise device.

C3. The method of section C1 or C2, wherein operating the exercise device with the display in the first rotational position includes operating the exercise device associated with a first exercise activity and operating the exercise device with the display in the second rotational position includes operating the exercise device associated with a second exercise activity.

C4. The method of section C3, further comprising changing from the first exercise activity to the second exercise activity.

C5. The method of section C4, wherein rotating the display and translating the display occur while changing from the first exercise activity to the second exercise activity.

C6. The method of section C4 or C5, wherein rotating the display includes rotating the display using a rotation motor and translating the display includes translating the display using a translation motor.

C7. The method of any of sections C3-C6, wherein operating the exercise device with the display in the first rotational position includes displaying exercise information associated with the first exercise activity on the display.

C8. The method of any of sections C3-C7, wherein operating the exercise device with the display in the second rotational position and second translational position includes displaying exercise information associated with the second exercise activity on the display.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An exercise device, comprising:

a frame;

a display movably connected to the frame between a first rotational position, a second rotational position, a first translational position, and a second translational position;

a translation mechanism, wherein the display is laterally movable along an approximately horizontal axis between the first translational position and the second translational position using the translation mechanism;

a rotation mechanism, wherein the display is movable rotatable about an approximately vertical axis between the first rotational position and the second rotational position using the rotation mechanism; and a component connected to the frame and positioned to physically prevent rotation of the display to the second rotational position when the display is in the first rotational position and the first translational position or visually obscure at least a portion of the display when the display is in the second rotational position and the first translational position, wherein, when the display is in the second translational position, the component does not block prevent the rotation of the display from the first rotational position to the second rotational position nor obscure the portion of the display when the display is in the second rotational position.

2. The exercise device of claim 1, wherein, in the first translation al position, a display center point is aligned with a device center point of the exercise device and, in the second translational position, the display center point is not aligned with the device center point of the exercise device.

3. The exercise device of claim 1, wherein the translation mechanism includes a motor to move the display from the first translational position to the second translational position.

4. The exercise device of claim 1, wherein the translation mechanism includes a slot and a wheel.

5. The exercise device of claim 1, further comprising a pivot mechanism, wherein the pivot mechanism is connected to the display.

6. The exercise device of claim 1, wherein the rotation mechanism includes a motor to move the display between the first rotational position and the second rotational position.

7. The exercise device of claim 1, wherein the component of the exercise device includes one or more handles.

8. The exercise device of claim 1, wherein the exercise device is a treadmill.

9. The exercise device of claim 1, wherein, in the first rotational position, the display faces the exercise device, and in the second rotational position, the display faces away from an operating surface of the exercise device.

10. The exercise device of claim 1, further comprising electrical wiring, wherein the electrical wiring is routed through an arm connecting the display to the frame.

11. A movable console for exercise device, comprising:

a housing;

a display in the housing;

a post connecting the housing to a frame of the exercise device;

a translation mechanism connecting the housing to the post, wherein the housing is laterally movable along an approximately horizontal translation axis along the translation mechanism; and a rotation mechanism connecting the post to the frame, wherein the housing is rotatable with the rotation mechanism about an approximately vertical rotation axis, wherein the translation approximately vertical rotation axis is transverse to the approximately horizontal translation axis.

12. The movable console of claim 11, wherein a component of the exercise device blocks prevents rotation of the housing in one or more translation al positions.

13. The movable console of claim 11, wherein a component of the exercise device visually obscures at least a portion of the display in one or more translation al positions.

14. The movable console of claim 11, further comprising a pivot mechanism at the housing, wherein the housing is movable about the pivot mechanism to adjust a tilt of the housing.

15. The movable console of claim 11, wherein the rotation mechanism rotates the post.

16. A method for operating an exercise device, comprising: operating the exercise device with a display in a first rotational position and a first translational position;

rotating the display around about an approximately vertical axis to a second rotational position, wherein a component of the exercise device prevents viewing the display in the second rotational position and the first translational position;

translating the display laterally along an approximately horizontal axis from the first translational position to a second translational position; and operating the exercise device with the display in the second rotational position and the second translational position, wherein the component of the exercise device does not prevent viewing the display in the second rotational position and the second translational position.

17. The method of claim 16, wherein the component of the exercise device obscures at least a portion of the exercise device to a user standing to a side of the exercise device.

18. The method of claim 16, wherein operating the exercise device with the display in the first rotational position includes operating the exercise device associated with a first exercise activity and operating the exercise device with the display in the second rotational position includes operating the exercise device associated with a second exercise activity.

19. The method of claim 18, further comprising changing from the first exercise activity to the second exercise activity.

20. The method of claim 19, wherein rotating the display and translating the display occur while changing from the first exercise activity to the second exercise activity.

* * * * *